US010625498B2

(12) United States Patent
Martinez et al.

(10) Patent No.: US 10,625,498 B2
(45) Date of Patent: Apr. 21, 2020

(54) TRANSPORTABLE GARMENT PRINTING PLATEN

(71) Applicant: Leo Martinez, Jr., Buena Park, CA (US)

(72) Inventors: Leo Martinez, Buena Park, CA (US); Leo Martinez, Jr., Buena Park, CA (US)

(73) Assignee: Leo Martinez, Jr., Buena Park, CA (US)

( * ) Notice: Subject to any disclaimer, the term of this patent is extended or adjusted under 35 U.S.C. 154(b) by 67 days.

(21) Appl. No.: 15/732,624

(22) Filed: Dec. 1, 2017

(65) Prior Publication Data

US 2019/0168500 A1 Jun. 6, 2019

(51) Int. Cl.
*B41F 15/08* (2006.01)
*B41F 15/18* (2006.01)
(Continued)

(52) U.S. Cl.
CPC ..... *B41F 15/18* (2013.01); *B41F 15/00* (2013.01); *B41F 15/08* (2013.01);
(Continued)

(58) Field of Classification Search
CPC ..... B41F 15/00; B41F 15/08; B41F 15/10; B41F 15/18; B41F 15/863; B41F 17/003;
(Continued)

(56) References Cited

U.S. PATENT DOCUMENTS 4,478,144 A * 10/1984 Maloof ..... B41F 15/0895 101/126
4,753,161 A * 6/1988 Kimball ..... B41F 15/18 101/115
(Continued)

FOREIGN PATENT DOCUMENTS

CN 104487256 A 4/2015

OTHER PUBLICATIONS

"Little Sister System II" S&K Mfg. www.littlesister.com Pub. date unknown Retrieved Oct. 3, 2017.
(Continued)

*Primary Examiner* — Leslie J Evanisko
*Assistant Examiner* — Marissa Ferguson-Samreth
(74) *Attorney, Agent, or Firm* — Charles H. Thomas

(57) ABSTRACT

A garment printing machine is provided with a transportable platen that can be utilized to significantly decrease the delay in printing expended in loading and unloading a garment for printing in either a digitized garment printing machine or a screen garment printing machine. The platen is provided with structure that holds a print receiving area of a garment firmly in position atop a print panel support plate that forms a part of the platen. Furthermore, the invention includes a platen support structure that cooperates with the conventional couplings' on existing conventional garment printing machines. A plurality of transportable platens constructed according to the invention are utilized interchangeably so that while one garment loaded on one of the platens is being
(Continued)

printed upon in the printing machine, the prior garment just printed upon is unloaded and the next garment to be printed is loaded onto another identical platen. This totally avoids any delay in printing due to loading and unloading of garments on the platens.

21 Claims, 35 Drawing Sheets

(51) Int. Cl.

| | |
|---|---|
| ***B41F 15/10*** | (2006.01) |
| ***B41J 11/02*** | (2006.01) |
| ***B41J 3/407*** | (2006.01) |
| ***B41F 17/00*** | (2006.01) |
| ***B41F 15/00*** | (2006.01) |
| ***D06P 5/30*** | (2006.01) |

(52) U.S. Cl.
CPC ..... *B41F 15/0863* (2013.01); *B41F 15/10* (2013.01); *B41F 17/003* (2013.01); *B41F 17/005* (2013.01); *B41J 3/4078* (2013.01); *B41J 11/02* (2013.01); *D06P 5/30* (2013.01); *B41P 2217/60* (2013.01)

(58) Field of Classification Search
CPC ..... B41F 17/005; B41J 3/4078; B41J 11/02; B41P 2217/60; D06P 5/30
See application file for complete search history.

(56) References Cited

U.S. PATENT DOCUMENTS

| | | | | | |
|---|---|---|---|---|---|
| 4,819,559 | A * | 4/1989 | Szarka | B41F 15/0863 | 101/126 |
| 5,014,614 | A * | 5/1991 | Thieme | B41F 15/0895 | 101/126 |
| 5,090,313 | A * | 2/1992 | Chapman | B41F 15/0863 | 101/115 |
| 5,107,758 | A | 4/1992 | Withers | | |
| 5,161,466 | A | 11/1992 | Burris | | |
| 5,588,770 | A | 12/1996 | Bart | | |
| 6,095,628 | A * | 8/2000 | Rhome | B41J 3/4078 | 347/105 |
| 6,640,714 | B1 * | 11/2003 | Papa | B41F 15/0863 | 101/126 |
| 6,775,934 | B1 * | 8/2004 | Gallik | D05C 9/04 | 112/103 |
| 6,908,190 | B2 * | 6/2005 | Iwatsuki | B41J 3/4078 | 101/474 |
| 7,765,927 | B1 * | 8/2010 | Liu | B41F 15/0895 | 101/126 |
| 9,085,849 | B2 * | 7/2015 | Takeuchi | B41J 3/4078 | |
| 9,434,187 | B2 * | 9/2016 | Mashima | B41J 3/4078 | |
| 10,046,553 | B2 * | 8/2018 | Hoffman, Jr. | B41M 1/12 | |
| 2005/0068400 | A1 * | 3/2005 | Niimi | B41J 3/4078 | 347/104 |
| 2009/0188404 | A1 * | 7/2009 | Styles | A42C 3/00 | 101/407.1 |
| 2009/0223391 | A1 * | 9/2009 | Keith | B41F 15/0863 | 101/41 |
| 2013/0017330 | A1 * | 1/2013 | Padilla | B41M 5/0047 | 427/256 |

OTHER PUBLICATIONS

"Brother GT-541 Little Sister Sys vs. Factory Platen" S&K Mfg. screen shots 1-4 www.youtube.com/watch?v=NYeQU-jLMBc&t=167s Robt. Bohannan Publ. May 25, 2009 Retrieved Oct. 3, 2017.

"Brother GT-541 Little Sister vs. Factory Platen" S&K Mfg. www.youtu.be/dTwHZpcvJZc Robt. Bohannan Publ. May 25, 2009 Retrieved Oct. 3, 2017.

"Brother GT-541 Little Sister System-GT541-DGT" S&K Mfg. www.youtube.com/watch?v=5ByWm9TQy8E Robt. Bohannan Publ. May 2, 2009 Retrieved Oct. 3, 2017.

"How to Assemble the Little Sister System II" S&K Mfg. www.youtube.com/watch?v=EmmuAft=II Robt. Bohannan Publ. Feb. 18, 2013 Retrieved Oct. 3, 2017.

"Little Sister System GT-541 GT541-Platen for Rt to Lft—oversized prints" S&K Mfg. www.youtube.com/watch?v=CsonkLYYfW8 Robt. Bohannan Publ. Apr. 22, 2010 Retrieved Oct. 3, 2017.

"Little Sister System GT-541 GT541—Sleeve Pattern" S&K Mfg. www.youtube.com/watch?v=-KFBLn5aMWg Robert Bohannan Publ. Apr. 22, 2010 Retrieved Oct. 3, 2017.

"Little Sister System Top to Bottom Oversized Platen for GT-541" S&K Mfg. www.youtube.com/watch?v=s6JgkcFcL30 Robert Bohannan Publ. Apr. 22, 2010 Retrieved Oct. 3, 2017.

"Little Sister System GT-541 Neck Pattern" S&K Mfg. www.youtube.com/watch?v=OG6RUBPzURw Robert Bohannan Publ. Apr. 22, 2010 Retrieved Oct. 3, 2017.

"Little Sister System Full Sleeve and Neckline Platen" S&K Mfg. www.youtube.com/watch?v=AjsLhLswlFw Robert Bohannan Publ. Sep. 3, 2009 Retrieved Oct. 3, 2017.

"Little Sister System Oversized Printing Right to Left for Brother GT-541" S&K Mfg. https://www.youtube.com/watch?v=Lthbj Robert Bohannan Publ. Sep. 3, 2009 Retrieved Oct. 3, 2017.

"Little Sister System Top to Bottom LSSCS for Brother" S&K Mfg. www.youtube.com/watch?v=SzwJu5-dAel Robert Bohannan Publ. Sep. 3, 2009 Retrieved Oct. 3, 2017.

"Little Sister System Top to Bottom and Shoulder to Shoulder" S&K Mfg. www.youtube.com/watch?v=O6hefEc8Xlk Robert Bohannan Publ. Jun. 1, 2009 Retrieved Oct. 3, 2017.

"GT 381 GT-3 Series Garment Printer with CMYK and 4 White Print Heads" Brothers USA Specification 2 pages www.brother-usa.com Publ. date unknown Retrieved Oct. 3, 2017.

Workhorse Odyssey Press—6 Color/4 Station www.anthemprintingsf.com Publ. date unknown Retrieved Oct. 3, 2017.

"Start Printing Caps on Your GT Printer" GT Cap Platen www,capplaten.com Publ. date unknown Retrieved Oct. 3, 2017.

"Features of the GT Cap Platen" GT Cap Platen www,capplaten.com/features.html#easy Publ. date unknown Retrieved Oct. 3, 2017.

"Hat Champ" Livington Systems www.livingstonsystems.com/product-category/screen-printing/hat-champ Publ. date unknown Retrieved Oct. 3, 2017.

"Fernando Cap Platen" Stitch City photos 1-12 taken at public demonstration performed on Apr. 27, 2017.

"Cap Platen Insert T-Lock Platen—Multipurpose Platen for Brother GT-541 GT-782 GT-3 Printers" T Lock Platen tlockplaten.com/cap-platen/ Pub date unknown Retrieved Oct. 3, 2017.

Polyprint Screen to DTG Mix at ISS Long Beach 2017 Shirt Printing Thedtgprinter.com youtu.be/dTwHZpcvJZc Publ Jan. 13, 2017 Retrieved Oct. 22, 2017.

"Polyprint's Texjet Plus Advanced DTG Printer—Screen & Digital Mix" Amaga UK www.youtube.com/watch?v=yBzQ63VHDg4 Publ May 28, 2015 Retrieved Oct. 22, 2017.

"Polyprint FESPA hybrid demo 02" Junga Nagata riso www.youtube.com/watch?y=vGR1MdJospA Pub. Jun. 17, 2015 Retrieved Oct. 22, 2017.

"GOCCOPRO screen print & DTG combination print" Junya Nagata riso www.youtube.com/watch?v=wRU2vffPGSE Publ Dec. 26, 2015 Retrieved Oct. 22, 2017.

* cited by examiner

TRANSPORTABLE GARMENT PRINTING PLATEN

BACKGROUND OF THE INVENTION

Field of the Invention

The present invention relates to an improvement in machines for printing images on a garments and an improved method of printing on garments. The improvement of the invention is applicable both to digital printing machines and manual screen printing machines.

Description of the Prior Art

Manual machines for printing images on garments, such as shirts, scarves, and pants have been in use for quite a number of years. In a simplified version where a design having a single color is to be imprinted, the machine has a single arm bearing a platen with a screen located above the platen. A garment, such as a shirt, is manually loaded onto the platen and positioned manually at a predetermined location on the platen. The screen is lowered onto the garment and ink is applied through the screen. The screen has a mask that allows ink to be transferred to the garment only at the unmasked location or locations. Once the ink has been applied, the screen is lifted. The garment is removed from the platen and the next garment to which the design is to be applied is manually loaded onto the platen, The printed garment is placed upon a conveyor and passed through a heating machine that dries the ink.

When designs of a plurality of colors are to be applied, a more complex type of garment printing machine is required. A typical conventional manual screen printing machine for printing multicolored designs on garments may employ a device with a number of arms mounted upon a central hub. Each arm carries a single screen. The hub or turntable is rotated to sequentially bring each screen into alignment with a platen upon which a garment is mounted for printing. The printing screen aligned with the platen is lowered into contact with the garment at the printing station. Each screen contains a mask that allows ink to be applied to only a certain area or areas located directly beneath the screen. At each station ink is spread across the screen where it is imprinted upon the garment at the location or locations that are not masked. A different color ink is applied through each screen onto the garment.

The screens on their rotating arms are advanced sequentially, where they apply the color of ink used for each screen. The masks for each of the screens are different so that designs of different colors are imprinted upon each garment as the screens complete their circuit over the platen with the garment mounted upon it. After the last screen the garment is removed and a new blank garment is loaded onto the platen. Only after the printed garment has been unloaded from the platen and a new garment mounted thereon for printing is are the screens again advanced to print on the next garment. As each garment is completed it is manually removed from the platen after the last screen and placed onto a conveyor that passes the garment through a heater to dry the ink.

Digital printing machines have also been devised and are now in widespread commercial use. These machines work somewhat similarly to inkjet printers for printing words and designs from a computer onto paper. In digital garment printing machines there is a single garment receiving arm that is extended and then retracted to a single printing station in the machine. A platen for bearing the garment to be printed is secured to the end of the garment receiving arm that is extended and withdrawn relative to the printing station In digital printing the garment is manually loaded onto the platen at the end of the garment receiving arm of the digital printer when the arm is extended. Once the next garment to be printed has been mounted on it, the arm is retracted into the machine for the garment to be printed with a computerized, preselected design at the printing station. In digital printing the inkjets are located quite close to, but not in contact with the garment to be printed. Once printing is complete the garment receiving arm is extended out from the printing station where the garment can be manually removed from the platen. With the platen still in position secured to the garment receiving arm of the digitized printing machine, a new, blank garment to be printed is then loaded onto the platen and the cyclical process of printing the garments is repeated.

With conventional garment printing machines a considerable amount of time is consumed in loading and unloading garments from the printing platens that are attached to the garment printing machine arms. Using conventional equipment, the platen to be unloaded and reloaded remains stationary and attached to the printing machine garment receiving arm while a printed garment is removed from it and replaced with the next garment to be printed. It takes approximately 16 seconds to unload and reload a conventional platen. During this time no printing is taking place. Only when the new garment is positioned on the platen can printing resume. The printing process itself takes approximately 30 seconds. Therefore, the complete cycle to unload and reload the platen and print the garment takes approximately 46 seconds.

With the present invention, however, the time required to remove a platen with a printed garment from the printing machine and replace it with an identical platen having a fresh garment mounted thereon for printing takes only about four seconds. Unloading a printed garment from a platen and reloading that platen with a fresh garment to be printed at a garment unloading and loading station near the printer takes place while the printing machine is printing an image on the garment previously loaded on another platen. Consequently, the printing machine is idle only about 4 seconds rather than 16 seconds for each garment to be printed. This represents an increase in garment unloading and reloading efficiency of 400%

SUMMARY OF THE INVENTION

The huge increase in efficiency of unloading and reloading a garment on a garment printing machine is made possible through the provision of a transportable garment printing platen. Actually a plurality of identical transportable garment printing platens are employed. Instead of remaining in position on the garment receiving arm of the garment printing machine, the platen of the invention is freely removable therefrom, although it is held tightly in a printing position and restrained from any horizontal movement relative to the garment receiving arm during the actual printing process.

As the printing machine brings the platen with the printed garment thereon to the station at which the garment is removed, not just the garment, but the entire platen with the garment mounted thereon is removed from the platen receiving arm of the garment printing machine and quickly replaced with another platen upon which a fresh garment has already been preloaded and mounted for printing. During the time the machine is printing on the garment that has been positioned for printing, the operator is concurrently unloading the printed garment from the platen just removed from the printing machine at a nearby master unloading and loading station and then reloading that platen with another platen bearing a fresh garment to be printed. This is done concurrently while the machine is still printing on the garment mounted on the platen that is positioned on the garment receiving arm of the machine. The process of unloading the printed garment and reloading the platen at the master station with the next garment to be printed takes less time than does the actual printing process performed by the machine. Consequently, the platen preloaded with the next garment to be printed is already for transfer onto the garment receiving arm of the printing machine before printing of the previous garment is completed. As a result, when the garment receiving arm is extended following printing, the platen with the newly printed garment is positioned by the machine for removal by the operator. The freshly loaded platen is ready for mounting upon the garment receiving arm as soon as the platen with the printed garment mounted thereon is removed. This exchange of platens each bearing a garment takes only approximately 4 seconds.

A plurality of identically constructed interchangeable platens are utilized to achieve the time-saving process of unloading and reloading described. Each platen is designed so that no special assembly is required and no modification of the printing machine is required. To the contrary, a master platen support is provided and is configured to fit into the printing machine. The master platen support is also configured to receive each platen that is dropped onto it. Each platen fits onto the master platen support which in turn fits onto the existing garment receiving arm of a conventional garment printing machine. No modification of any conventional garment printing machine, either digital or screen printing, is required. To the contrary, the master platen support provides the adaptation that allows a transportable platen, constructed according to the present invention, to be used with different models of conventional garment printing machines.

In one broad aspect the present invention may be considered to be a mechanism for a garment printing machine having at least one horizontally extending garment receiving arm. The mechanism is comprised of a platen support on the garment receiving arm and a transportable platen freely removable from the platen support. The platen is comprised of a horizontally extending garment mount having a flat horizontally upwardly facing support surface, the mount further including an apparatus for immobilizing at least a print receiving portion of a garment positioned thereon relative to the platen. This apparatus urges the print receiving portion of the garment into contact with the upwardly facing support surface of the platen. The platen and the platen support together have at least one registration set of at least one mating, vertically extending projection and at least one vertically extending recess that are slidably vertically and engageable with each other when the platen resides atop and in contact with the platen support. The projection and recess of each set are slidable vertically so as to be disengageable from each other when the platen is raised above the platen support. When the platen rests atop the platen support, the projection extends into the recess to immobilize the platen from all movement other than vertical movement relative to the platen support. When the platen is raised above the platen support, the projection and recess in each set disengage from each other and the platen is freely movable and totally detached from the platen support.

A single registration set comprising a single projection and a single recess may be utilized to make the system operable. In such an embodiment the projection and recess must each be configured to have a mating, noncircular cross-section. For example, a projection and recess may both have a mating polygonal or oval cross-section. The cross-sectional dimensions of the recess are just slightly larger than those of the projection, so that the projection fits smoothly into the recess, but is prevented from any movement relative thereto other than in a vertical direction. The projection may be formed to extend downwardly from the platen with the recess formed in the platen support. Conversely, the recess may be formed in the platen with the projection extending upwardly from the platen support. All such variations are encompassed within the scope of the present invention.

In the preferred embodiment of the invention a plurality of registration sets of projections and recesses are defined in the platen and platen support, and all of said projections and recesses have mating, circular cross-sections. Preferably also, the projections are formed to extend downwardly from the platen while the mating recesses are formed in the platen support.

In another broad aspect the invention may be considered to be the combination of a transportable platen and a platen support for a garment printing machine having at least one horizontally extending garment receiving arm upon which the platen support is secured. The transportable platen is freely removable from the platen support. The transportable platen is comprised of a horizontally extending garment mount having a flat, horizontal upwardly facing garment support surface with a peripheral margin thereabout. The mount further includes an apparatus for immobilizing at least a print receiving portion of a garment positioned thereon relative to the transportable platen and for urging the print receiving portion of the garment into contact with the horizontal, upwardly facing garment support surface of the transportable platen. The transportable platen together with the platen support have at least one mating, vertically extending projection and at least one vertically extending recess that are slidably engageable with each other in a vertical direction when the transportable platen resides atop and in contact with the platen support. The projection and recess are slidingly disengageable from each other in a vertical direction when the transportable platen is lifted from the platen support in vertical separation therefrom. When the transportable platen resides atop the platen support, the projection extends into the recess to mobilize the transportable platen from all movement other than vertical movement relative to the platen support. When the transportable platen is raised above the platen support the projection and recess disengage from each other and the transportable platen is freely and totally detached from the platen support.

The invention may also be described as a transportable platen for use in printing on a flexible garment that has a forward portion, a rearward portion, a print receiving portion located therebetween, and a capturable portion. The transportable platen is comprised of a rigid base plate, a pedestal secured atop the rigid base plate, a flat, rigid print support panel plate, a plurality of registration projections depending vertically from the underside of the base plate, a garment depressing mechanism, and a stretching insert. The flat rigid print panel support plate has a bottom surface and a flat top surface and is secured at its bottom surface atop the pedestal. It overhangs the pedestal so as to create opposing first and second gaps between the bottom surface of the print panel support plate and the upper surface of the base plate. The first gap receives the capturable portion of the garment therewithin. The garment depressing mechanism is mounted on the base plate and is engageable with the forward portion of the garment to urge the forward portion of the garment into contact with the flat upper surface of the base plate. The stretching insert is removably engageable with a rearward portion of the garment and is insertable into the second one of the opposing gaps. The stretching insert jams the rearward portion of the garment into the second one of the opposing gaps to thereby stretch the print receiving portion of the garment in a fore and aft direction. This urges the print receiving portion of the garment into contact with the flat upper surface of the print panel support plate. The vast majority of garments to which printing is applied are shirts, such as T-shirts and sweatshirts. Other types of garments, such as hats, are also imprinted with designs, logos and lettering utilizing the conventional screen printing machines and digital printing machines of the type previously described herein. The present invention is applicable to virtually any type of garment including shirts, hats, but also shorts, pants, scarves and all other types of garments.

Printing upon hats involves difficulties not encountered in printing upon other types of garments. This is because hats, by their nature, do not readily present flat surfaces upon which designs, logos and lettering can be easily printed. The present invention provides a transportable platen with a unique construction that facilitates printing upon both the forehead area and the bill or visor area of a hat.

The transportable platen of the invention that is particularly applicable to printing on hats employs a front panel wrap locking system. This allows the printing machine operator to tuck in and secure the hat atop the flat top surface of the print panel support plate in such a manner as to facilitate rapid loading and unloading of the hat. Moreover, the top of the bill of the hat is flattened so as to keep it out of the way of the printing mechanism of a conventional garment printing machine and also allow clear printing on it.

The platen of the invention may be used both on screen printing and digital printing machines. The platen holds the garment tightly in position so that the artwork or other printed material is printed exactly at the proper location of the garment. Unlike many prior garment printing systems, the platen of the invention employs no clamps or clips in order to hold the garment immobilized relative to the print receiving support surface of the platen.

In still another broad aspect the invention is a method of imprinting garments utilizing a plurality of platens adapted to receive a garment thereon having a print receiving portion each of the platen is comprised of:

a flat top surface and an undersurface, preferably with at least one registration projection depending vertically therefrom, and a garment depressing mechanism engageable with the garment to urge the print receiving portion of the garment into contact with the flat top surface of the platen. The steps of the invention comprise:

mounting a garment to be printed on a first of the platens, employing the garment depressing mechanism to urge the print receiving portion of the garment into contact with the flat top surface of the platen, removing a second of the plurality of platens having a garment mounted thereon that has already been imprinted with ink by a printing machine by lifting a the second platen vertically upwardly from a platen support attached to a garment receiving arm of the printing machine, and replacing it by placing the first platen on the garment support thereby mobilizing the first platen from all but vertical movement relative to the platen support. When registration pins depending from the underside of the platen are provided, the registration pins fit into corresponding apertures in the platen support to perform this function. The printing process of the invention continues by actuating the printing machine to imprint ink upon the print receiving portion of the garment mounted up on the first platen. The first platen is thereafter removed from the platen support by lifting it vertically upwardly therefrom. The garment mounted on the first platen is then removed from it.

The invention may be described with greater clarity and particularity by reference to the accompanying drawings.

DESCRIPTION OF THE EMBODIMENTS

Figure 1:
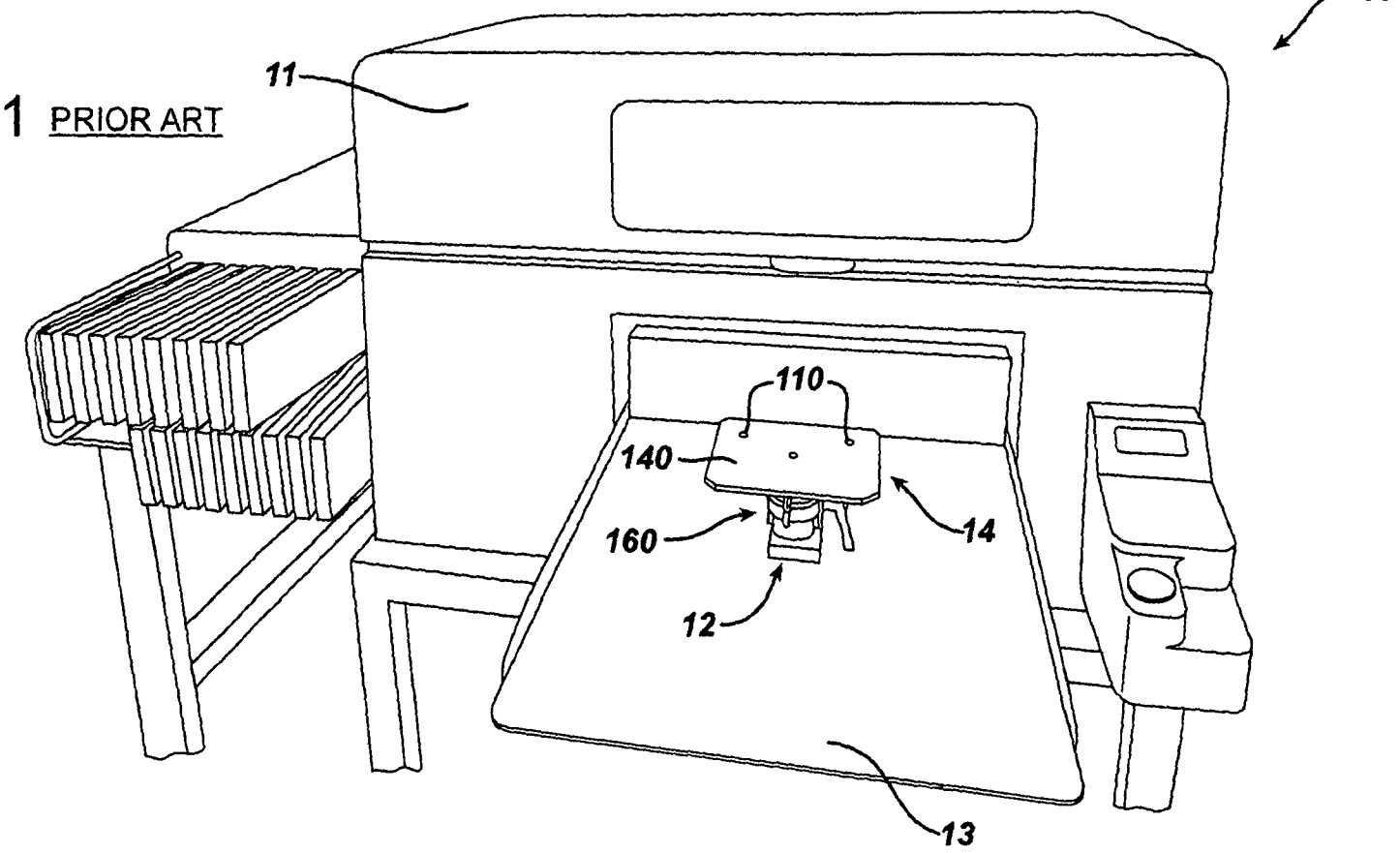
FIG. 1 PRIOR ART
FIG. 1 is a perspective view of an otherwise conventional digitized garment printing machine having one horizontally extending garment receiving arm and a platen support according to the invention mounted on the garment receiving arm.

FIG. 1 illustrates a conventional digitized printing machine 10 having a horizontally extending garment receiving arm 12. A platen support 14 constructed according to the invention is mounted on the projecting end of the horizontally extending garment receiving arm 12. The garment receiving arm 12 extends outwardly away from the console of 11 of the garment printing machine 10 and resides above a work platform 13. The digitized printing machine 10 may, for example, be a Brothers GT3 81 machine, although the invention may be utilized with most commercially available digitized garment printing machines.

For purposes of reference throughout this specification, the directions fore and aft and longitudinal should be considered as parallel to the alignment of the garment receiving arm 12 on the printing machine 10, with forward referring to the direction toward the console of 11 and aft referring to the direction away from the console 11. Foreword also refers to the location closest to the console 11 of the digitized printing machine 10, while rearward and aft respectively refer to the direction and location most distant from the console 11 of the digitized printing machine 10. Lateral refers to the direction or alignment perpendicular to the alignment of the garment receiving arm 12.

Figure 2:
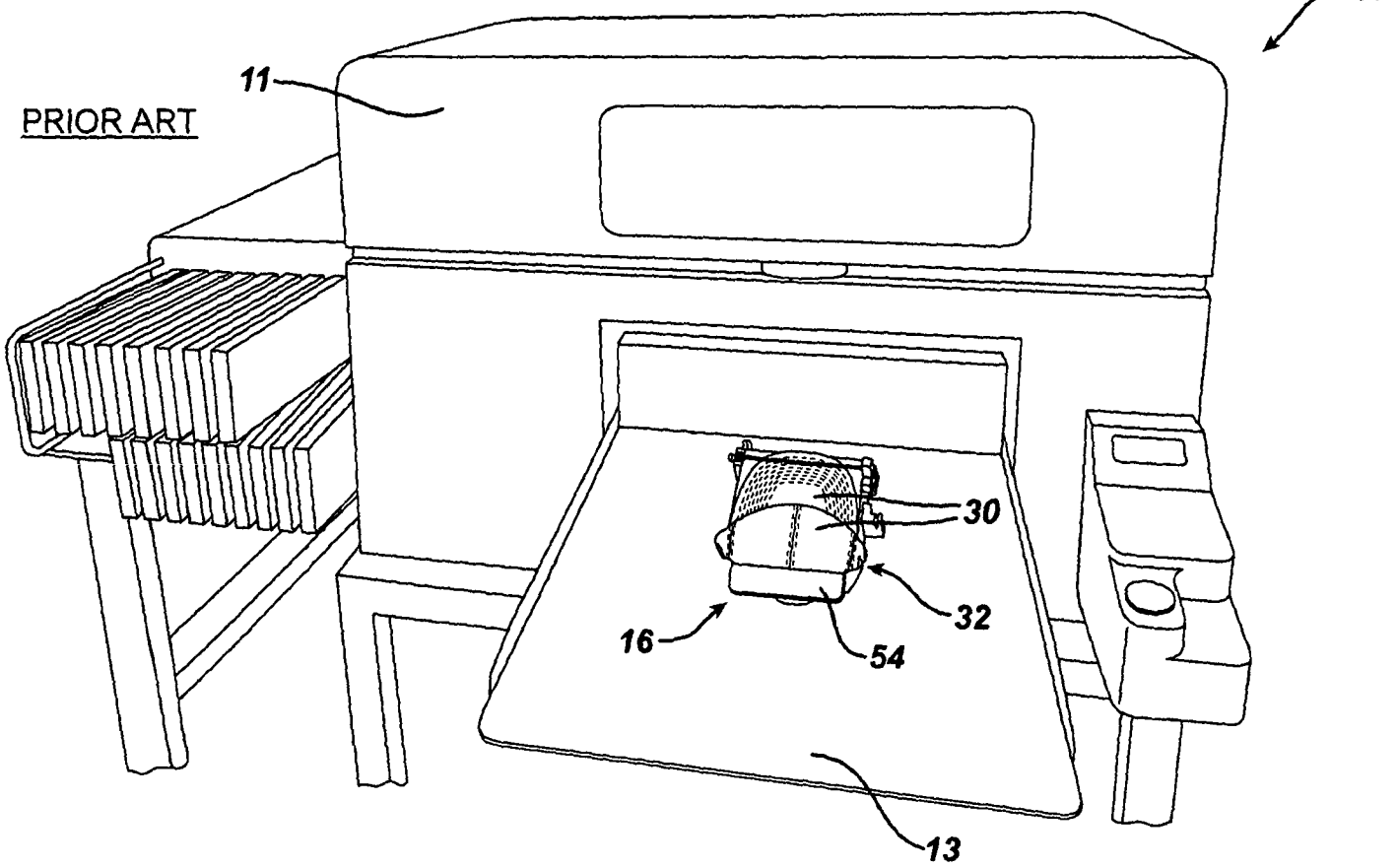
FIG. 2 PRIOR ART
FIG. 2 is a perspective view of the digitized garment printing machine of FIG. 1 upon which a transportable platen constructed according to the present invention and having a hat mounted for printing thereon is positioned atop the platen support.
Figure 10:
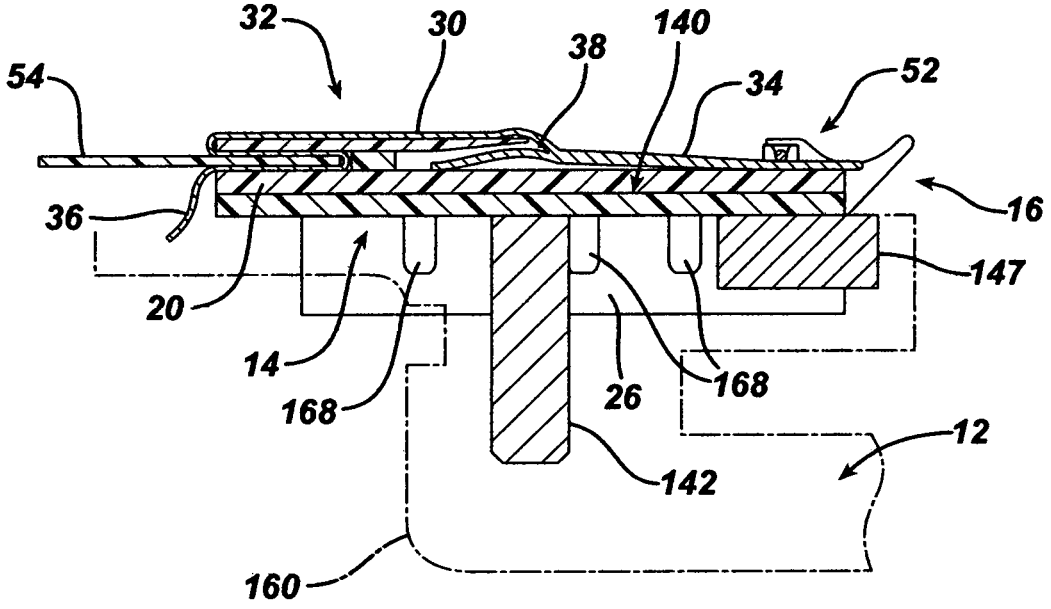
FIG. 10 is a sectional elevational view taken along the lines 9-9 of FIG. 8 with the platen located atop the platen support shown in FIG. 1.

The garment receiving arm 12 may be considered to extend in a rearword or aft direction relative to the garment printing machine console 11. The mechanism of the invention is also comprised of a transportable platen 16 that is freely removable from the platen support 14, but is also engageable therewith as illustrated in FIGS. 2 and 10.

As illustrated in FIGS. 4-7 the transportable platen 16 is comprised of a horizontally extending garment mount 18 that includes a flat, rigid baseplate 20 shaped generally in the form of an irregular hexagon and having an undersurface 24 an upper surface 22, and a pair of narrow, mutually parallel guide strips 26. The baseplate 20 is about 6½ inches in length and about 7¼ inches in width. The guide strips 26 depend from the undersurface 24 at the lateral extremities thereof and extend in a fore and aft direction. The longitudinally extending guide strips 26 have a rectangular cross-sectional and are spaced apart a distance to just accommodate the width of the platen support 14. The purpose of the guide strips 26 is to ensure that the baseplate 20 is laterally centered atop the platen support 14, which is secured to the rear end of the garment receiving arm 12.

The mount 18 further includes an apparatus for immobilizing at least a print receiving portion 30 of a garment, which may be a hat 32 as illustrated. In FIGS. 2 and 7-10. The immobilizing apparatus also urges the print receiving portion 30 of the hat 32 into contact with the upwardly facing support surface 42 of the transportable platen 16.

Figure 14:
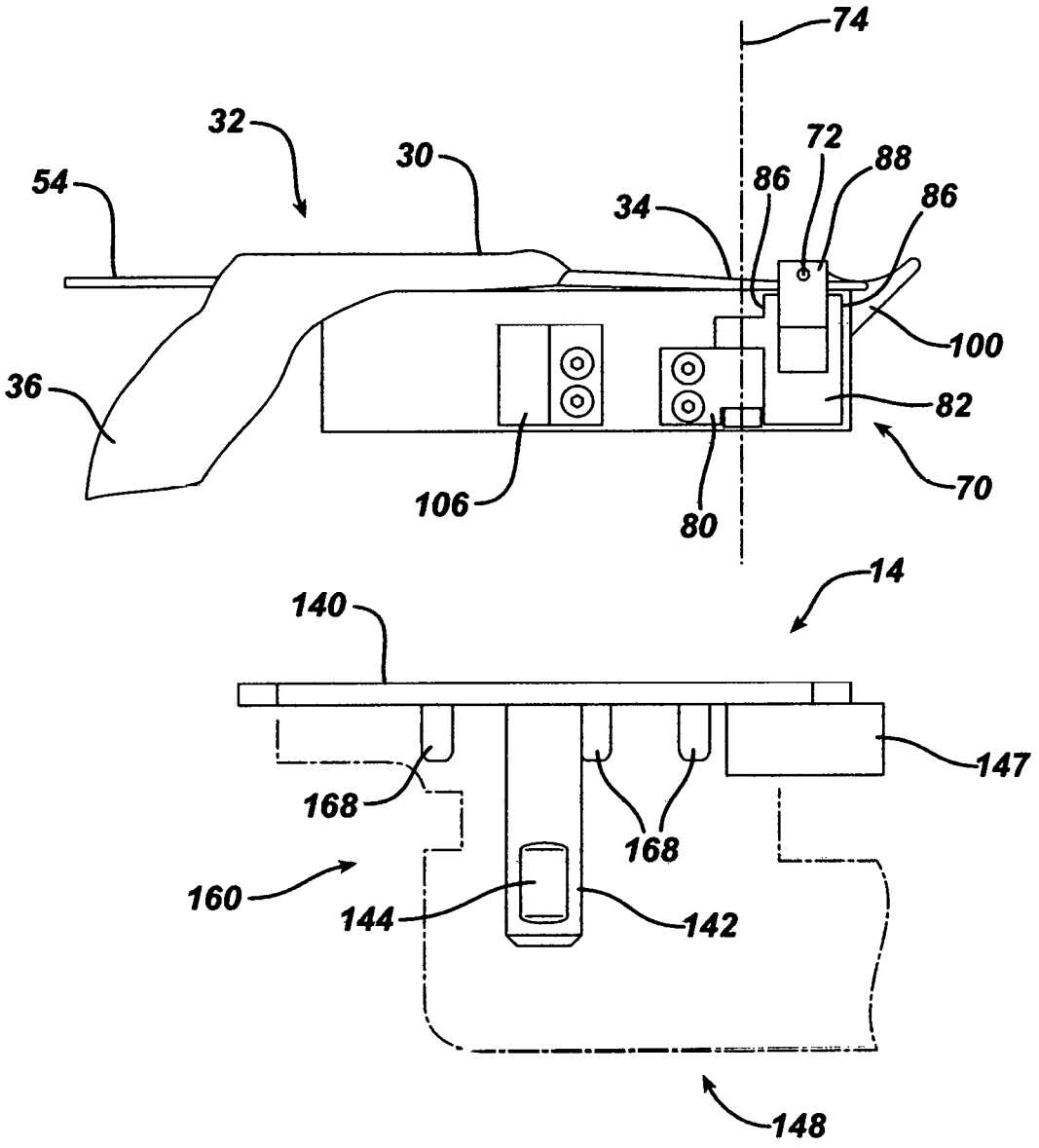
FIG. 14 is a side elevational view of the platen with the hat loaded thereon lifted above the platen support illustrated in FIGS. 1 and 10.
Figure 17:
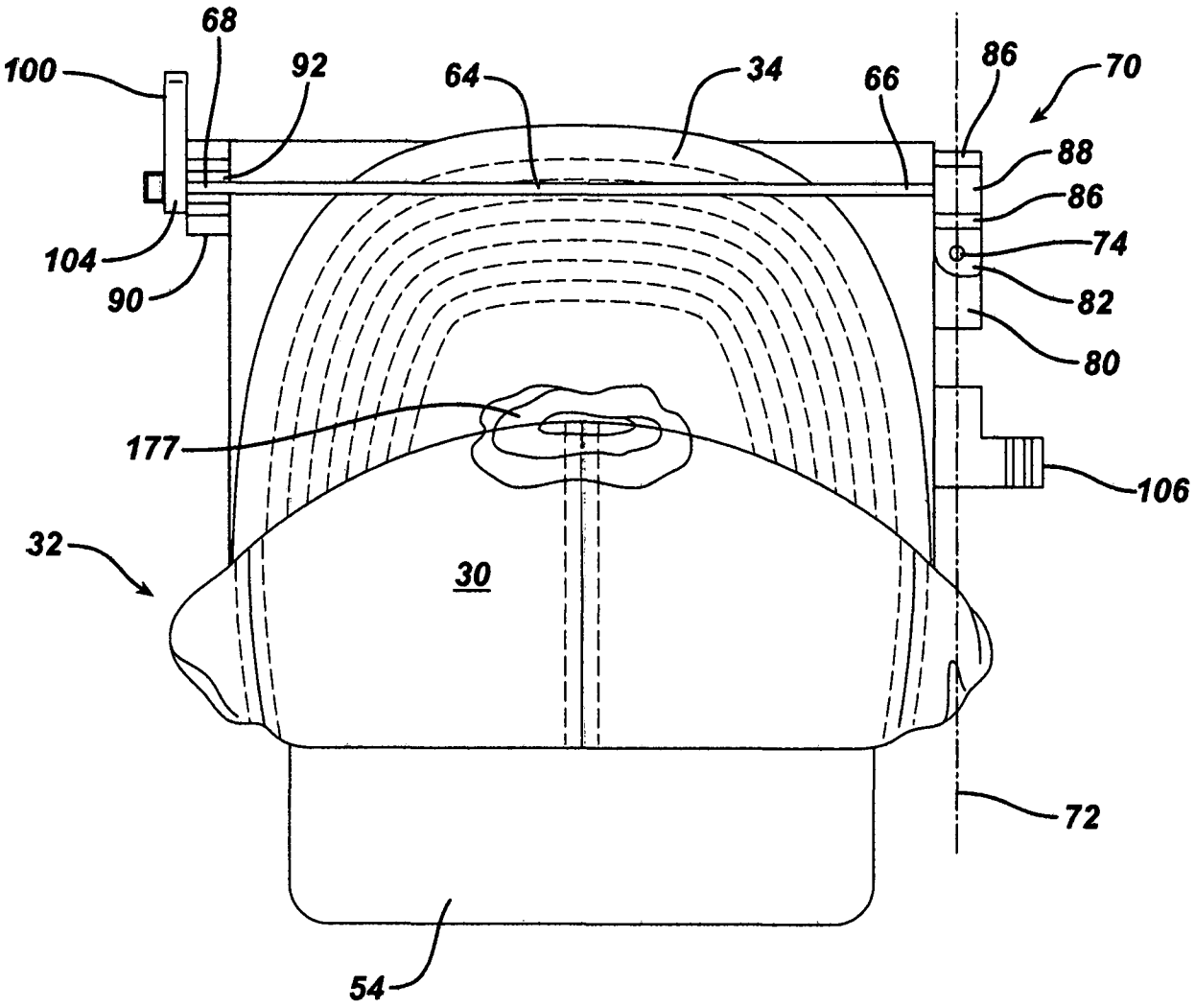
FIG. 17 is a top plan view of the transportable platen shown in FIG. 8 and with the hat mounted thereon following imprintation of a design on the hat by the garment printing machine illustrated in FIGS. 1 and 2.

The hat 32 has a forward portion 34, which is a bill or visor of the hat 32, a print receiving portion 30, a rear portion 36, best shown in FIG. 14, and a capturable portion 38 located between the print receiving portion 30 and the forward bill portion 34 of the hat 32. The print receiving portion 30 may include the frontal forehead area of the crown of the hat 32, the rearward portion of the hat bill 34, or both, as best illustrated in FIG. 17.

The immobilizing apparatus of the platen 16 includes a pedestal 40 that is secured atop the upper surface 22 of the rigid baseplate 20 and a flat rigid print panel support plate 42 having a bottom surface 44 and a flat top print receiving support surface 46. The print panel support plate 42 is secured at its bottom surface 44 atop the pedestal 40 and overhangs the pedestal 40 so as to create opposing first and second gaps 48 and 50, respectively. The gaps 48 and 50 are located between the bottom surface 44 of the print panel support plate 42 and the upper surface 22 of the baseplate 20.

The first gap 48 receives the capturable portion 38 of the hat 32 therewithin, as illustrated in FIG. 10. The immobilizing apparatus also includes a garment depressing mechanism 52 mounted on the baseplate 20 and engageable with the forward bill portion 34 of the hat 32 to urge the forward bill portion 34 of the hat 32 into contact with the flat upper surface 22 of the baseplate 20. The immobilizing apparatus further includes a stretching insert 54, illustrated in FIGS. 6 and 7-10, that is engageable with the rearward portion 36 of the hat 32. The stretching insert 54 is preferably shaped as a flat, generally rectangular thin sheet of plastic. The stretching insert 54 is insertable into the second gap of the opposing gaps 48 and 50, specifically the gap 50, to jam the rearward portion 36 of the hat 34 into the gap 50 by pushing the stretching insert 54 against the fabric of the rearward portion 36 of the hat 32. This stretches the print receiving portion 30 of the hat 32 in a fore and aft direction, and urges it into contact with the flat horizontally, upwardly facing top surface 46 of the print panel support plate 42.

Figure 3:
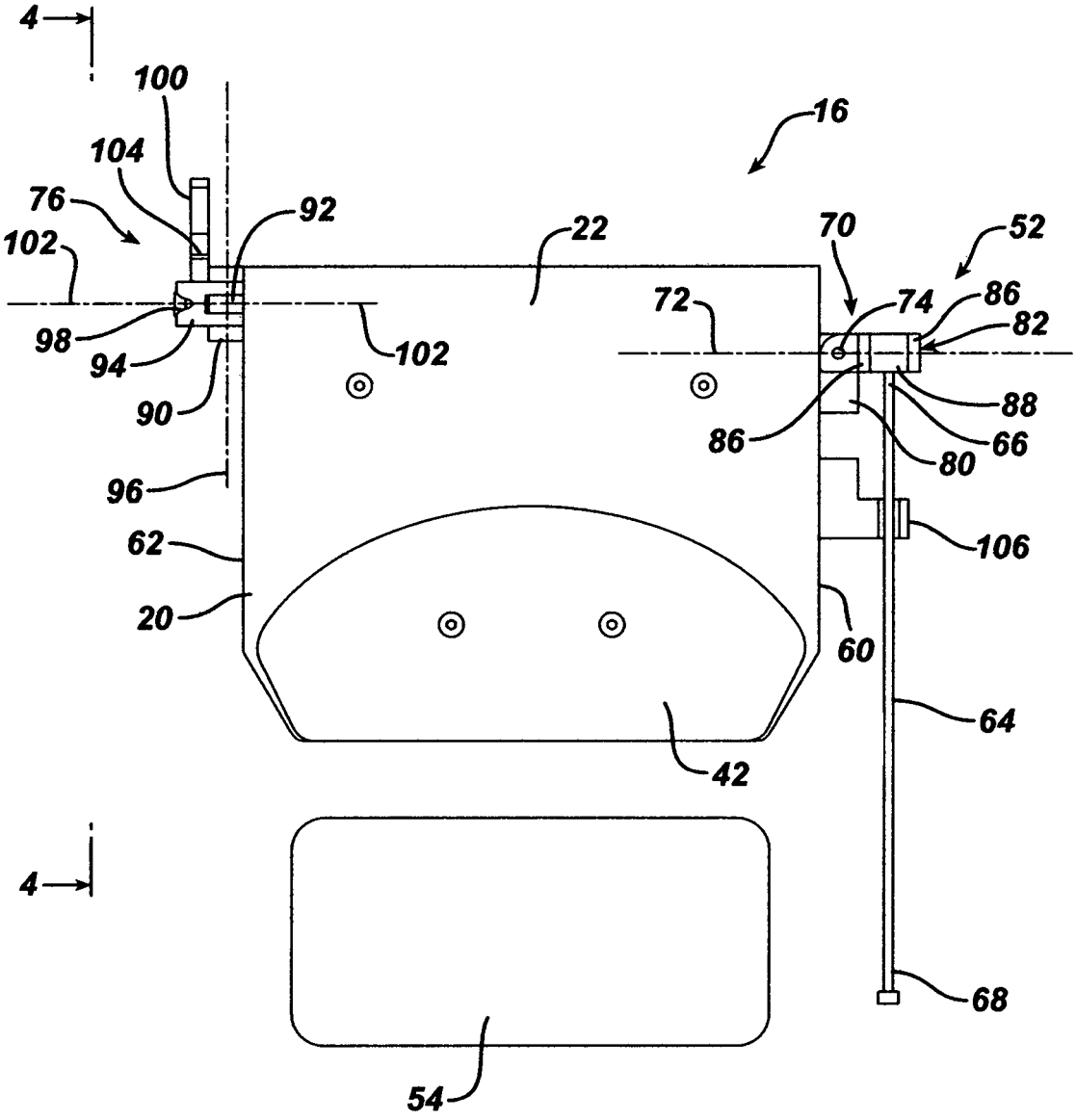
FIG. 3 is a top plan view of a portion of the transportable platen shown in FIG. 2 but without the hat mounted thereon.

In the embodiment of the transportable platen 16 illustrated in FIGS. 2-10 the print panel support plate 42 has an oblong shape when viewed from above, as shown in FIG. 3, and is about 4 inches in length in a fore and aft direction and has a width no greater than about 7 inches at its greatest lateral dimension. The first and second gaps 48 and 50 preferably have a vertical width no greater than about 3/16 of an inch. These dimensions are suitable to accommodate the most popular size hats upon which words, logos and other images are printed.

Figure 7:
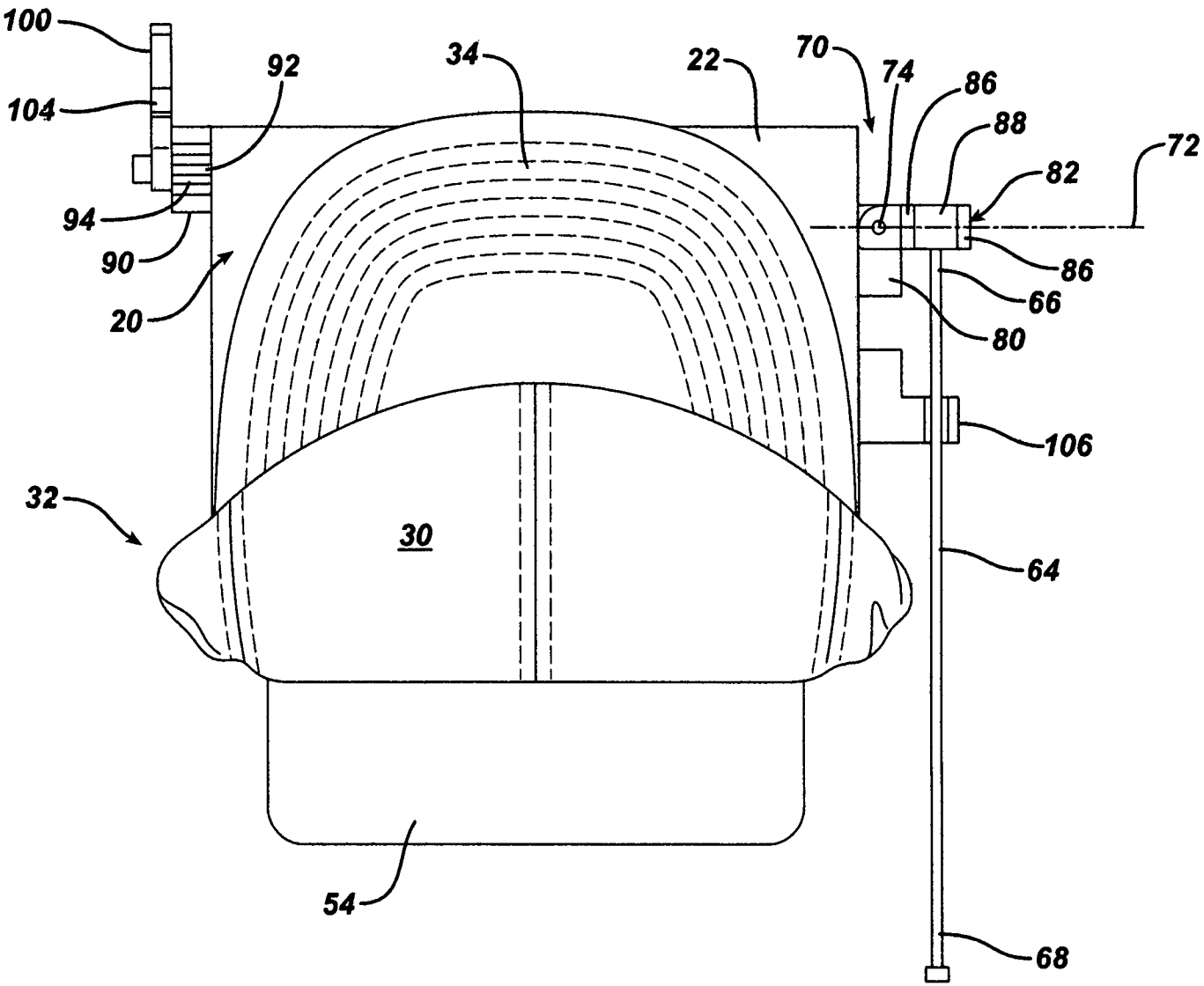
FIG. 7 is a top plan view of the platen shown in FIG. 4 with a hat mounted for printing thereon prior to engagement of the garment depressing mechanism.
Figure 8:
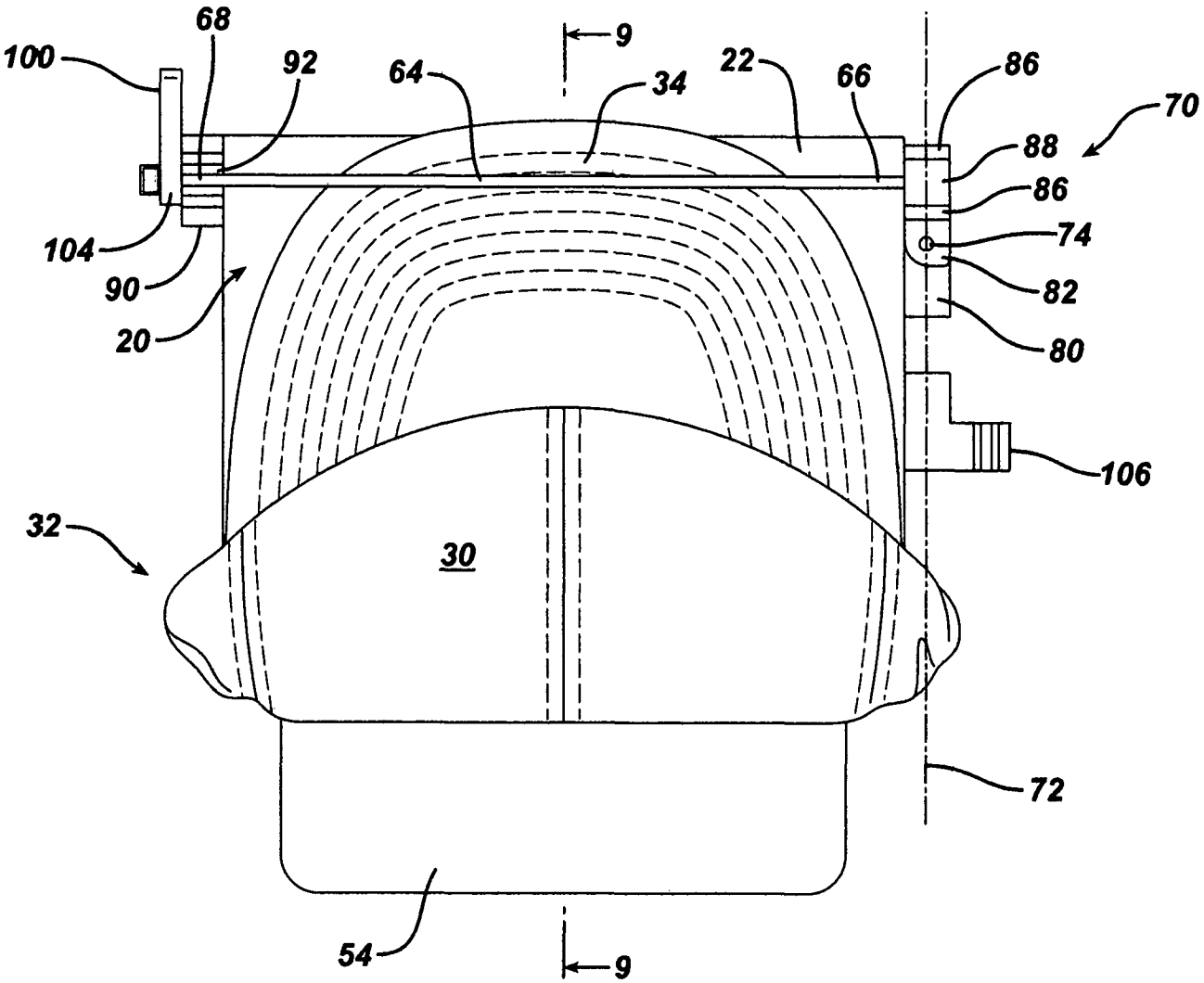
FIG. 8 is a top plan view of the platen and hat shown in FIG. 7 and with the garment depressing mechanism engaged to urge the forward portion of the hat into contact with the flat upper surface of the platen baseplate.
Figure 9:
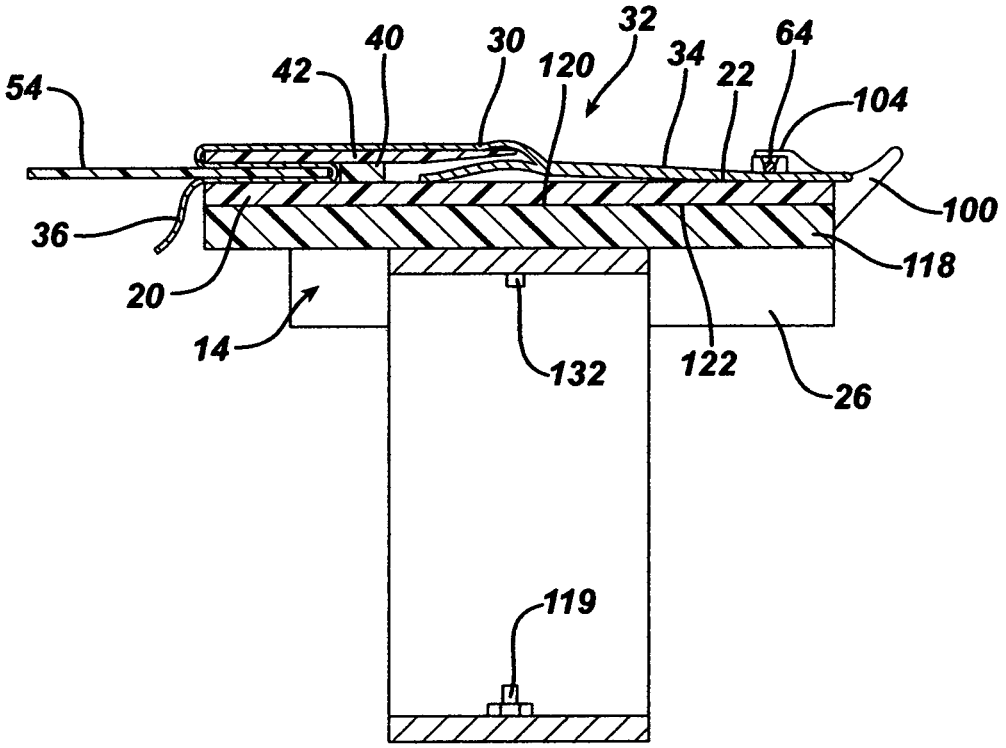
FIG. 9 is a sectional elevational view taken along the lines 9-9 of FIG. 8 with the platen located atop the master garment unloading and loading station shown in FIG. 6.

The baseplate 20 is formed with a pair of laterally separated first and second side edges 60 and 62, respectively, illustrated in FIG. 3. The side edges 60 and 62 extend in a fore and aft direction. The garment depressing mechanism 52 is formed with a holddown bar 64 having a proximal end 66 and a distal end 68. The garment depressing mechanism 52 has an articulated double hinge joint 70 located at the first side edge 60 of the baseplate 20. The double hinge joint 70 is secured to the proximal end 66 of the holddown bar 64 so as to permit rotation of the holddown bar 64 about both a horizontal axis of rotation 72 and a vertical axis of rotation 74. A holddown bar catch 76 is located at the forward extremity at the second side edge 62 of the baseplate 20. Consequently, the holddown bar 64 is rotatable to a deployed position to extend across the baseplate 20 in spaced separation from and above the upper surface 22 of the baseplate 20. The holddown bar 64 is engageable in the holddown bar catch 76 to press the forward, bill portion 34 of the hat 32 against the upper surface 22 of the baseplate 20, as illustrated in FIGS. 8-10. The holddown bar 64 is also rotatable to a storage position extending alongside the first side edge 60, as illustrated in FIG. 7.

The double hinge joint 70 is formed by a horizontally projecting hinge block 80 that protrudes laterally outwardly from the guide strip 26 at the side edge 60 of the baseplate 20 and defines a vertical axis of rotation 74 therethrough. The double hinge joint 70 also includes a vertically projecting hinge block 82 that is secured at its lower end to the forward end of the laterally extending hinge block 80. The upper end of the vertically projecting hinge block 82 is formed with a pair of ears 86 that define a horizontal axis of rotation 72 and receive a swivel block 88 that is mounted between the ears 86 for rotation about the horizontal axis 72.

The holddown bar catch 76 is constructed with a catch mounting block 90 projecting horizontally and laterally from the guide strip 26 located at the front end of the side edge 62 of the baseplate 20. The catch mounting block 90 has an upwardly projecting center mounting flange 92, formed as a post-flattened on its fore and aft sides, to which a holddown bar cradle 94 is mounted for rotation about a longitudinal, horizontal axis of rotation 96, shown in FIG. 3. The cradle 94 has a V-shaped seat 98 defined at its center to receive the distal end 68 of the holddown bar 64 when the cradle 94 is rotated to extend upwardly and the holddown bar 64 is moved to its deployed position illustrated in FIG. 8.

The holddown bar catch 76 also includes a catch retainer 100 that is hinged for rotation about a horizontal axis of rotation 102 that is oriented in a laterally extending orientation as illustrated in FIG. 3. At its end remote from the axis of rotation 102 the catch retainer 100 has a tooth 104 that captures the distal end 68 of the holddown bar 64 when the holddown bar 64 is moved to the deployed position illustrated in FIGS. 8-10. When the holddown bar 64 is in its deployed position and is engaged in the catch mechanism 76 by the tooth 104, the holddown bar 64 serves to urge the bill 34 of the hat downwardly into intimate contact with the upper surface 22 of the baseplate 20, as illustrated in FIGS. 8-10.

Figure 4:
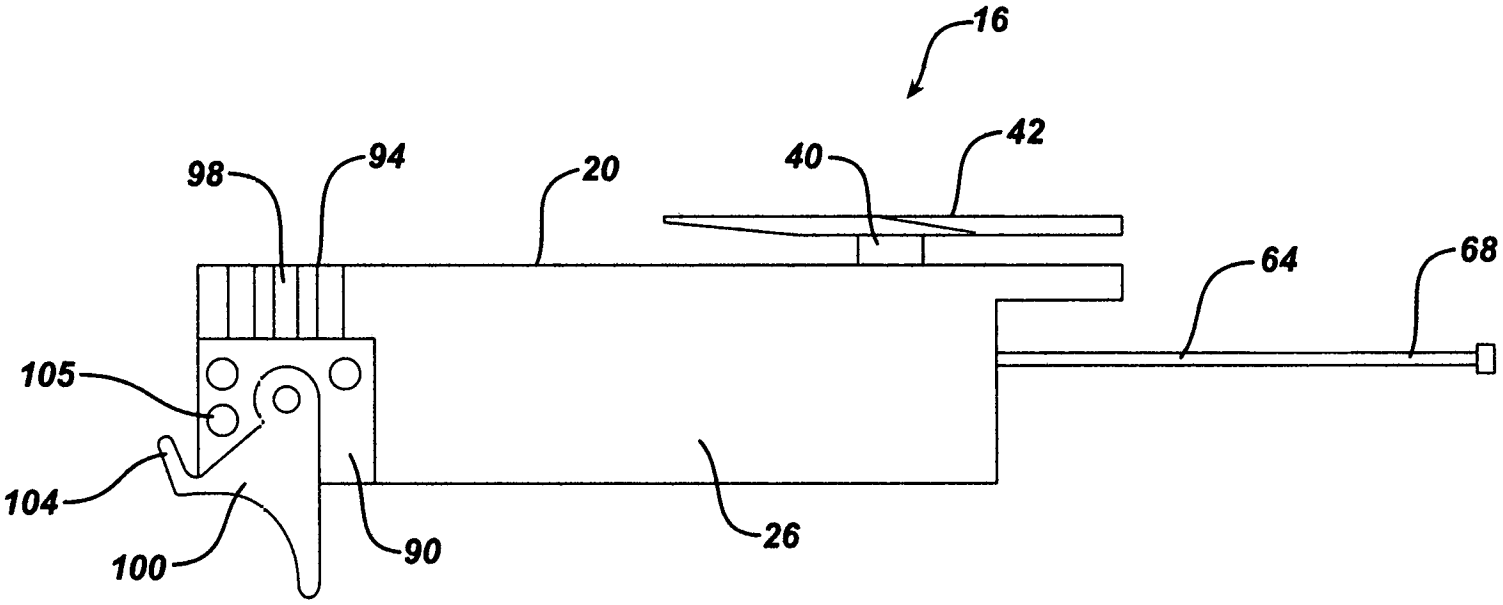
FIG. 4 is a side elevational view taken along the lines 4-4 in FIG. 3.
Figure 5:
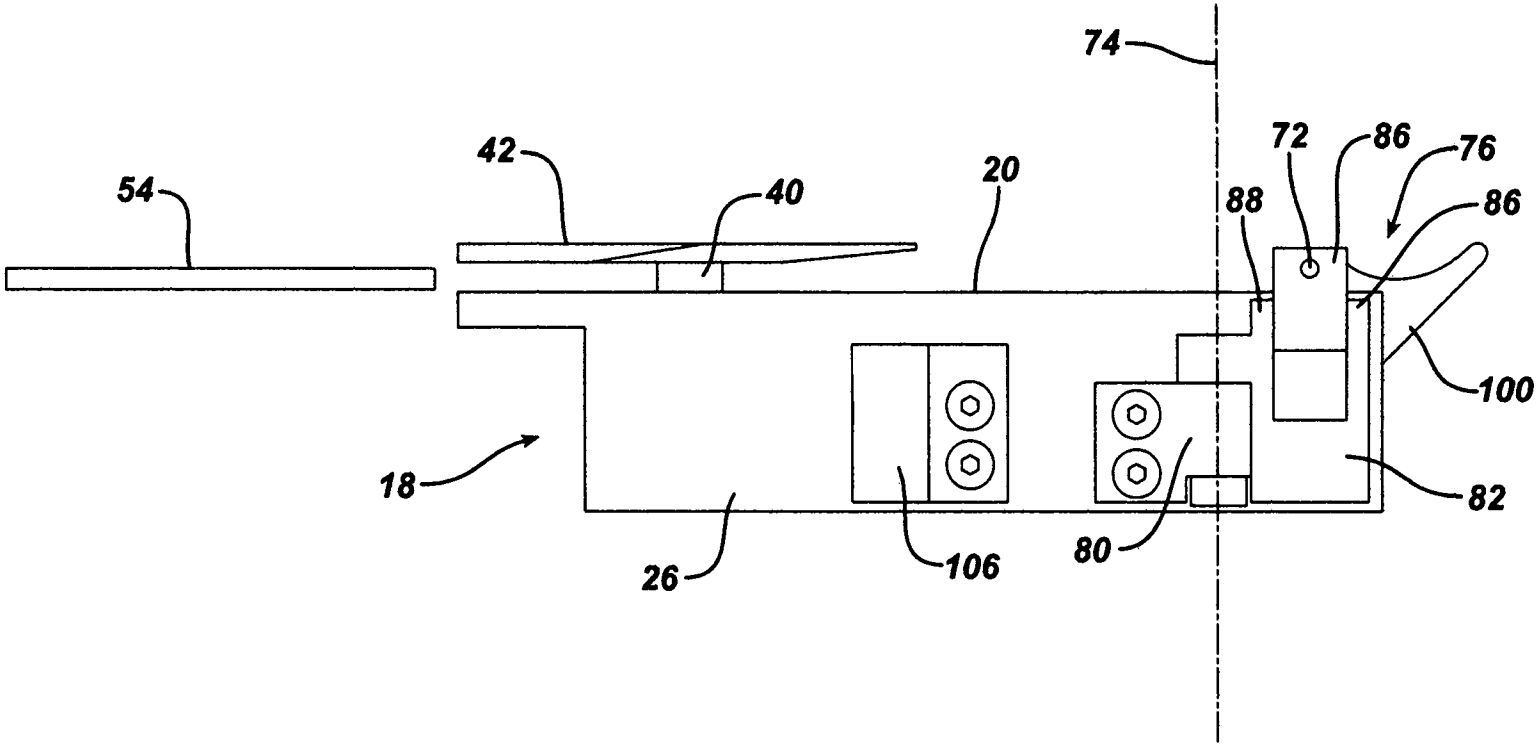
FIG. 5 is a side elevational view of the portion of the transportable platen shown in FIG. 3.
Figure 6:
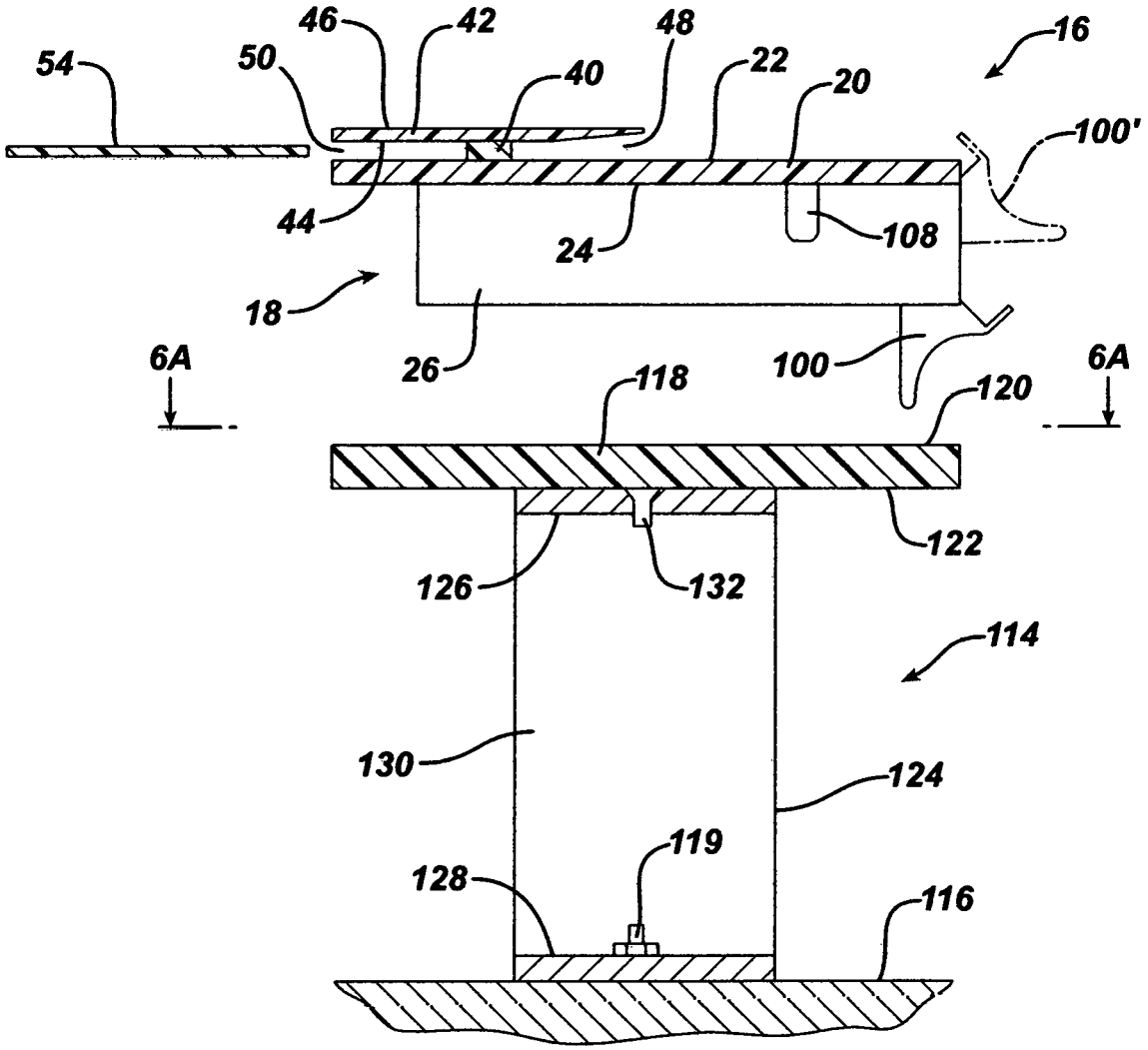
FIG. 6 is an exploded sectional elevational view of the transportable platen of FIG. 4 with the master garment unloading and loading station with which it is utilized located there beneath.

To reposition the holddown bar 64 to its storage position, illustrated in FIG. 3, from its deployed position, illustrated in FIG. 8, the catch retainer 100 is rotated in a clockwise direction from its position depicted in FIG. 9 to its disengaged position illustrated in phantom at 100' in FIG. 6 where it reclines backwardly upon a laterally projecting stud 105, visible in FIG. 4. Alternatively, after the catch retainer is first rotated in a clockwise direction to the position indicated in phantom at 100' in FIG. 6, the cradle 94 may be then rotated upwardly about its axis of rotation 96 to a vertical orientation. This provides clearance for the catch retainer 100 to then be counter rotated in a counterclockwise direction as viewed in FIG. 6 forwardly to where it hangs substantially vertically downwardly in a dangling position as illustrated in FIG. 4. The cradle 94 is then counter rotated back downwardly to rest atop the catch mounting block 90 as illustrated in FIG. 4.

Once the catch retainer 100 has been moved to either the disengaged position shown in phantom at 100' or the dangling position shown at 100 in FIGS. 4 and 6, the distal end 68 of the holddown bar 64 is released. Thereupon the vertically projecting hinge block 82 is rotated in a clockwise direction, about the vertical axis of rotation 74 from the position illustrated in FIG. 8 to the position illustrated in FIG. 7. The swivel block 88 is then rotated rearwardly to swing the holddown bar 64 rearwardly and bring it alongside the guide strip 26 at the side edge 60 of the baseplate 20 until it reaches the position illustrated in FIGS. 3 and 7. The holddown bar 64 is then moved into the seat formed in the seating block 106 that is attached to the guide strip 26 at the side edge 60 of the baseplate 20. The seating block 106 latches the holddown bar 64 alongside the baseplate 20 so that it does not interfere with loading of the next garment to be printed.

In printing upon hats 32 using a digital printing machine 10 illustrated in FIGS. 1 and 2, the catch retainer 100 is normally moved to the disengaged position indicated at 100' in FIG. 6 to release the holddown bar 64. This serves to minimize the time required for unloading the printed hat 32 shown in FIG. 17 from the transportable platen 16 and reloading the transportable platen 16 with the next hat 34 to be printed, as illustrated in FIG. 8.

Figure 11:
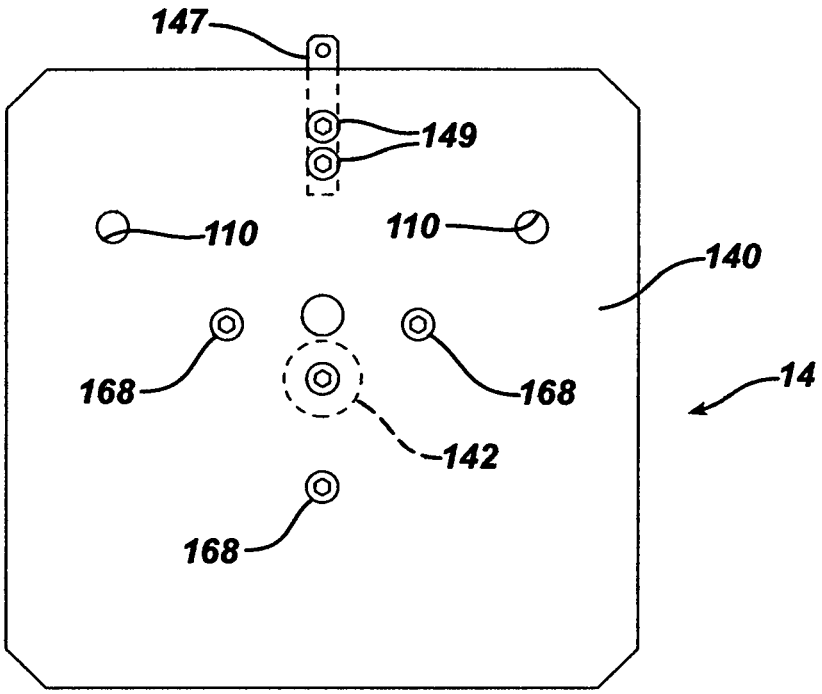
FIG. 11 is a top plan view of the platen support visible in FIG. 1, shown in isolation.
Figure 12:
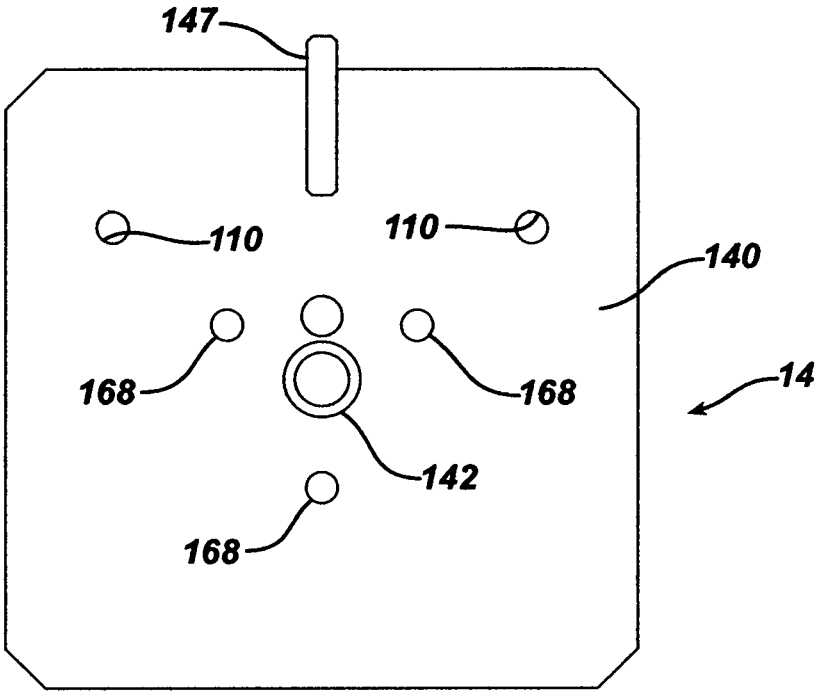
FIG. 12 is a bottom plan view of the platen support shown in FIG. 11.
Figure 13:
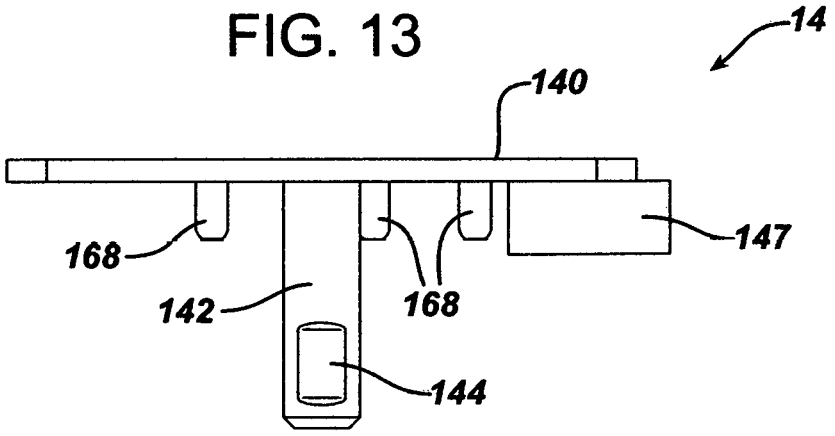
FIG. 13 is a side elevational view of the platen support shown in FIG. 11.

The platen 16 and the platen support 14 are provided with at least one registration set of at least one mating, vertically extending projection and at least one vertically extending recess. Preferably, a plurality of identical, interchangeable, transportable platens 16 are employed in the mechanism of the invention and a plurality of sets of mating projections and recesses are provided for each platen and the platen support. Preferably also, the projections are formed as a plurality of positioning pins 108 depending from the lower surface 24 of the baseplate 20 of each platen 16. The recesses are preferably formed as a corresponding plurality of positioning apertures 110 defined through the structure of the platen support 14, as illustrated in FIGS. 11 and 12. The positioning pins 108 and the positioning apertures 110 are preferably all of uniform circular cross-section.

The invention also preferably employs a master unloading and loading station 114 illustrated in FIGS. 6 and 9. The master unloading and loading station 114 is designed to be supported upon an upwardly facing, stationary working surface 116, as illustrated in FIGS. 6 and 9. The master unloading and loading station 114 includes an assembly platform 118 having a flat upper surface 120 and a lower surface 122. A master support 124 is secured to the lower surface 122 of the assembly platform 118 to hold it at a spaced elevation above the working surface 116. The master support is formed of a section of a square aluminum tube and has a top wall 126 a bottom wall 128 and supporting sidewalls 130 extending between the top wall 126 and the bottom wall 128. The assembly platform 118 is secured to the master support 124 by means of bolts or screws 132 extending through the assembly platform 118 and the top wall 126 of the master support 124. The master support 124 is preferably secured to the working surface 116 by bolts indicated at 119.

Figure 6A:
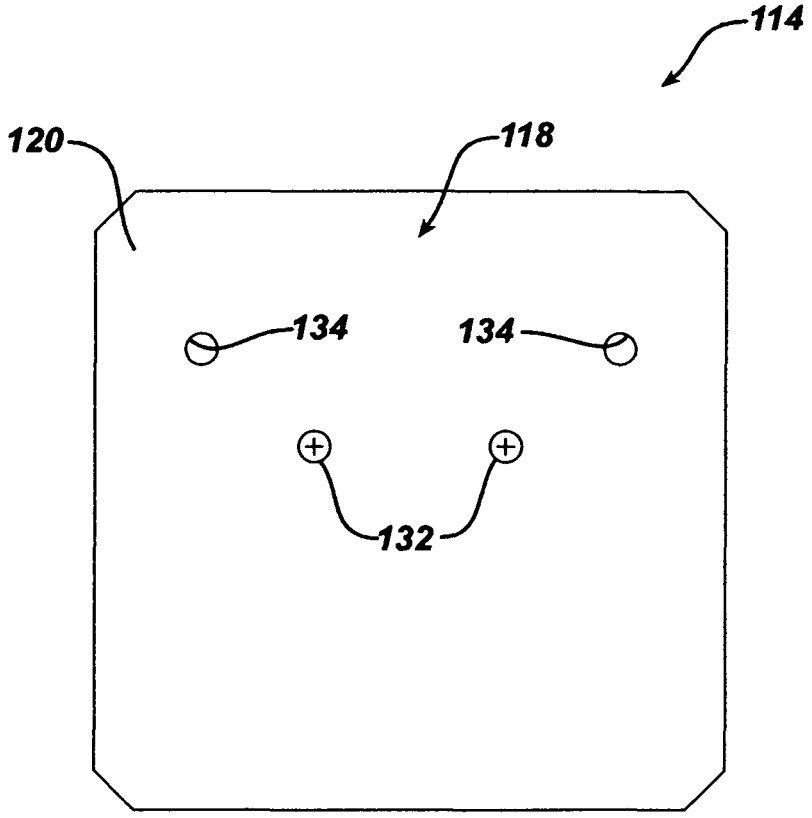
FIG. 6A is a top plan view of the assembly platform of the master garment unloading and loading station taken along the lines 6A-6A in FIG. 6.

The assembly platform 118 is equipped with positioning apertures 134, illustrated in FIG. 6A, to receive the positioning pins 108 of the platen 16. The positioning apertures 134 are spaced apart the same distance as the positioning pins 108 and are of a diameter defined to slidingly receive the positioning pins 108 therein. The positioning apertures 134 in the loading platform 118 are of the same diameter and relative spacing as the positioning apertures 110 in the platen support 14, illustrated in FIG. 11.

In the garment loading and unloading position in which the platen 116 rests atop the assembly platform 118 of the master unloading and loading station 114, illustrated in FIG. 9, the positioning pins 108 of the platen 16 project through the positioning apertures 134 in the assembly platform 118. The platen 116 is thereby immobilized from horizontal movement relative to the master support 114 by the engagement of the positioning pins 108 in the positioning apertures 134. However, when lifted vertically upwardly from the master unloading and loading station 114, as shown in FIG. 6, the platen 116 is otherwise freely and independently movable relative to the master unloading and loading station 114 since the positioning pins 108 and positioning apertures 134 are then disengaged from each other.

The apertures 110 in the platen support 14 are the same diameter and are spaced the same distance apart as the apertures 134 in the assembly platform 118. The platen support 14 is illustrated in detail in FIGS. 11-14. The platen support 14 is completely detachable from the garment receiving arm 12 of the garment printing machine 10. The platen support 14 is formed of a flat, generally rectangular plexiglass slab 140 having a width equal to the width of the undersurface 24 of the baseplate 20 of the platen 16. The platen support 14 has a center post 142 of generally cylindrical configuration, but with a vertically oriented flat area 144 adapted to receive a set screw 146.

Figure 15:
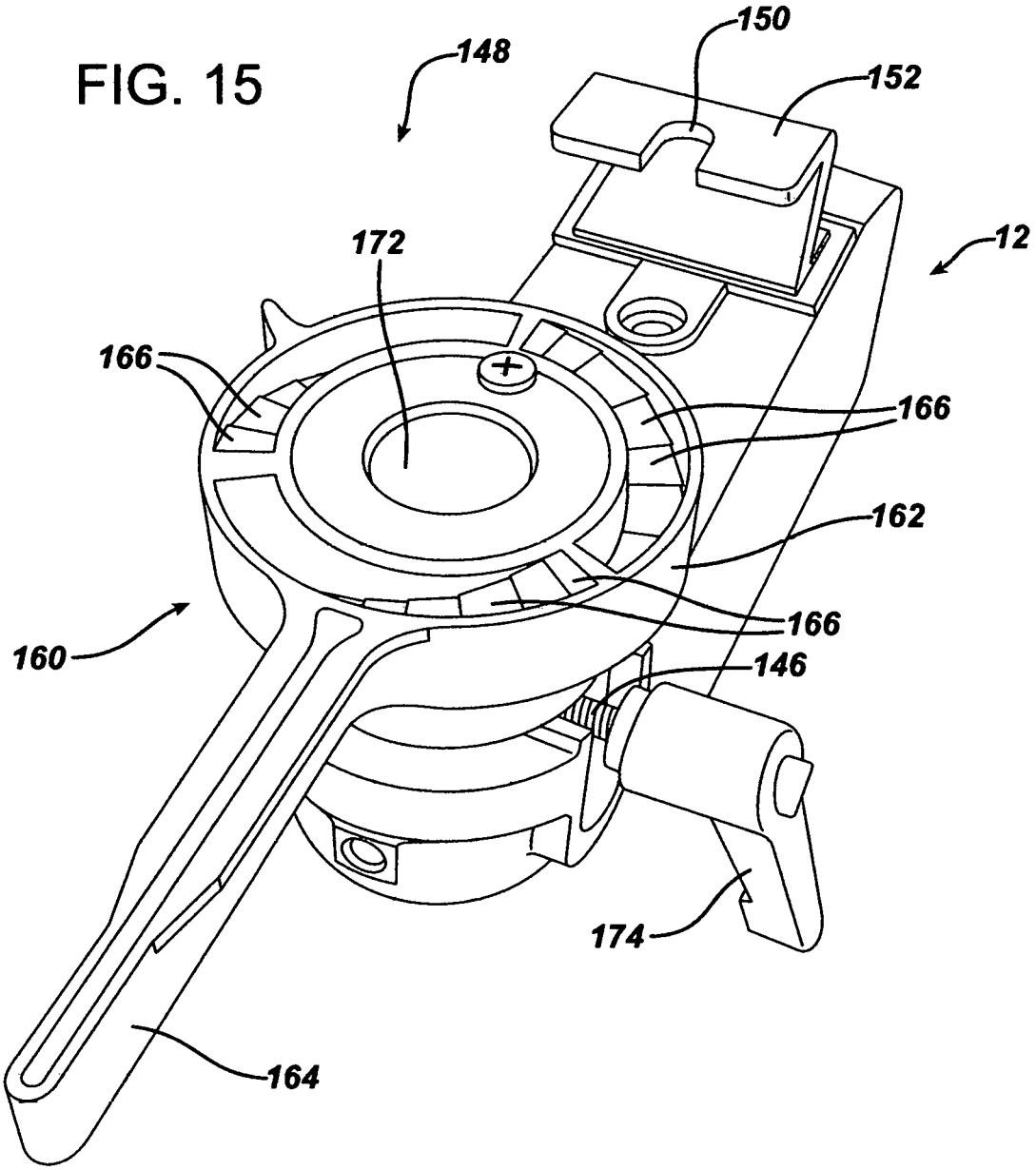
FIG. 15 is a perspective view of the garment receiving arm shown in FIG. 1 and illustrated with the platen support removed therefrom.
Figure 16:
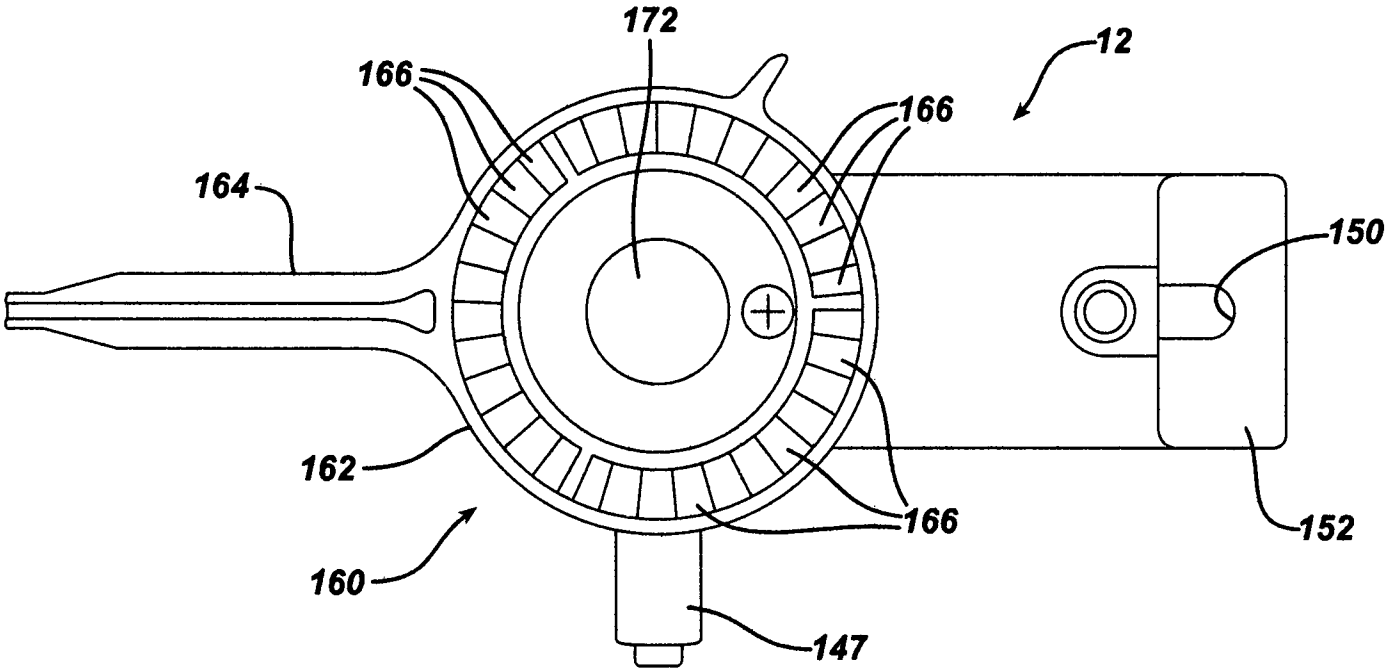
FIG. 16 is a top plan view of the garment receiving arm illustrated in FIG. 15.

The set screw 146 is part of the coupling mechanism 148, illustrated in FIGS. 15 and 16, which forms a conventional part of the digital printing machine 10. The platen support 14 also has an alignment flange 147 depending from the underside of the slab 140 and secured thereto by bolts 149. The alignment flange 147 is laterally centered at the underside of the slab 140 and projects forwardly therefrom a distance of about 5/16 of an inch. The alignment flange 147 is configured to fit into a notch 150 defined in a bracket 152 located on the garment receiving arm 12. The bracket 152 forms a part of the digitized printing machine coupling 148.

A typical conventional coupling mechanism 148 is depicted in detail in FIGS. 15 and 16. The coupling mechanism 148 is located at the rearwardly extending end of the garment receiving arm 12. The coupling mechanism 148 includes an elevation adjusting mechanism 160 designed to adjust the height of the conventional platen support which is replaced by the platen support 14 of the present invention. The platen support 14 of the present invention also interacts and cooperates with the elevation adjustment mechanism 160 to allow the platen 16 to be moved closer to or further from the print jets in the digitized printing machine 10.

More specifically, the conventional elevation adjustment mechanism 160 includes a cup 162 with a central, axial, vertical, cylindrical socket 172 formed therewithin The cup 162 is rotatable relative to the garment receiving arm 12 by means of a lever 164. Defined within the cup 162 are three spiral flights of steps having landings 166 located at ascending elevations within the cup 162. The platen support 14 of the present invention includes three corresponding generally cylindrical pegs 168 depending from the underside of the slab 140. The pegs 168 are located at a radial distance from the center post 142 equal to the radial distance of the spiral step landings 166 in the cup 162. The diameter of the center post 142 fits snugly into the central socket 172 of the elevation adjustment mechanism 160.

The lower extremities of the pegs 168 all rest at landings 166 that are of the same height in each of the three spiral flights of steps. The specific landings 166 upon which the pegs 168 rest is determined by rotation of the cup 162 by means of the handle 164. The platen support 14 may be elevated and lowered by rotation of the cup 162, but is prevented from any horizontal shifting or rotational movement by the constraint provided by the center post 142 in the socket 172 and the engagement of the flange 147 in the notch 150.

The positioning pegs 168 that depend from the underside of the slab 140 of the platen support 14 fit into the corresponding positioning receptacles, namely the landings 166 in the cup 162 on the garment receiving arm 12 of the garment printing machine 10. The interaction between the positioning pegs 168 and the landings 160, together with the positioning restraint provided by the projection of the flange 147 into the notch 150 in the bracket 152 on the garment receiving arm 12 prevents horizontal movement of the platen support 14, and consequently the platen 16 and as well, when the platen support 14 rests atop the garment receiving arm 12. However, when the set screw 146 is released by counterclockwise rotation of the handle 174, the garment support 14 is free to move vertically relative to the garment receiving arm 12 and its elevation may be adjusted relative thereto.

When the platen 16 is seated atop the garment support 14 as illustrated in FIG. 10, it is immobilized from all but vertical movement relative thereto. The platen 16 cannot shift in a fore and aft direction nor laterally. It also cannot rotate about a vertical axis relative to the platen support 14. Consequently, the hat 34 is likewise immobilized from all movement, except vertical movement, and therefore can be precisely positioned beneath the inkjets at the printing station of the digitized printing machine 10.

However, the platen 16 is freely movable in a vertical direction. Consequently, once the hat 32 has been imprinted, as illustrated in FIG. 17, the platen 16 carrying it can be lifted freely vertically and removed from the platen support 14. A different, identical platen 16, preloaded with the next hat 32 to be printed as illustrated in FIG. 8, is then dropped onto the platen support 14. It can be precisely positioned by centering the guide strips 26 along the opposing longitudinal sides of the slab 140 and moving the platen 16 forwardly or rearwardly until the registration projection pins 108 are brought into vertical alignment with the registration apertures 110 in the slab 140 of the platen support 14. Thereupon the platen 16 readily drops into position with the hat 32 precisely located for imprintation upon the print receiving portion 30 thereof.

The chronological sequence of utilization of the transportable platens 16 of the invention may be described in the following manner. At the start of operations, the platen support 14 is first positioned for a production run relative to the garment receiving arm 12 of the digitized printing machine 10 by adjusting the elevation adjusting mechanism 160, and by locking the set screw 146 against the flat 144 of the central post 142 of the platen support 14.

Once the handle 164 has been rotated to raise or lower the pegs 168 to the desired elevation, the set screw 146 is locked by clockwise rotation of the set screw handle 174. Once the handle 174 has locked the set screw 146 against the flat 144 of the center post 142, the platen support 14 is totally immobilized relative to the coupling mechanism 148 which is secured to the longitudinally projecting end of the garment receiving arm 12 of the digitized printing machine 10, as illustrated in FIG. 14. The platen support 14 is thereby immobilized from movement relative to the garment supporting arm 12 in all directions other than vertical.

The platens 16 of the present invention, however, are transportable and may be quickly and easily removed from the platen support 14 when the garment receiving arm 12 is extended as shown in FIG. 14.

To commence a printing run an unloaded platen 16 is first mounted onto the master garment transfer unloading and loading station 114 by simply positioning the platen 16 above the master garment transfer unloading and loading station 114, as illustrated in FIG. 6, and lowering it on to the master garment transfer unloading and loading station 114, as illustrated in FIG. 9. As the transportable platen 16 is lowered onto the master garment transfer unloading and loading station 114, guide strips 26 slide down along the side edges of the loading platform 118 to laterally center the transportable platen 16 relative to the loading platform 118. The registration projection pins 108 then slide smoothly into the positioning apertures 134 in the loading platform 118 so that the transportable platen 16 is immobilized from horizontal movement relative to the master transfer unloading and loading station 114, as shown in FIG. 9.

For the first hat 134 to be printed, the transportable platen 16 is initially empty, as illustrated in FIG. 6. However, for all subsequent hats the transportable platen 16 will bear a printed hat 32, as illustrated in FIG. 9. The hat on the transportable platen 16 that has just been removed from the platen support 14 will bear and imprintation, such as that illustrated at 177 in FIG. 17, for example.

The hat 32 illustrated in FIG. 8 has been loaded onto the platen 16 and is ready for imprintation of ink onto the print receiving area 30. The platen 16 is removed from the master unloading and loading station 114 and placed onto the platen support 14. Following imprintation, illustrated in FIG. 17. the platen 16 is removed from the platen support 14 and returned to the master unloading and loading station 114.

Once the transportable platen 16 is seated atop the master transfer unloading and loading station 114, as illustrated in FIG. 9, the catch retainer 100 is rotated clockwise, as viewed in FIGS. 6 and 9 from the position indicated at 100 in FIG. 9, to the phantom position indicated at 100' in FIG. 6. The holddown bar 64 is thereupon released and the swivel block 88 is rotated about the horizontal axis of rotation 72 defined through the ears 86 of the hinge block 80 thereby carrying the holddown rod 64 from the position illustrated in FIG. 8 upwardly away from the side edge 62 of the transportable platen 16, then downwardly and outwardly to project laterally away from the side edge 60 of the transportable platen 16. The hinge block 82 is then rotated in a clockwise direction about the vertical axis 74 to the position illustrated in FIG. 7. The holddown bar 64 is then pushed into the seating block 106 to latch the holddown bar 64 alongside the side edge 60 of the baseplate 20 to prevent the holddown bar 64 from interfering with the unloading of the printed hat 32 and loading of the next hat 32 to be printed.

With the holddown bar 64 in the position illustrated in FIG. 7, the printed hat 32 is removed from the transportable platen 16 by withdrawing the stretching insert 54 rearwardly to the position illustrated in FIG. 3 and free from the hat 32. The printed hat 32 is then pulled free from the print panel support plate 42 and the baseplate 20. The printed hat 32 is then unloaded by removing it entirely from the transportable platen 16.

The next hat 32 to be printed is then loaded onto the transportable platen 16 while it remains seated atop the garment transfer unloading and loading station 114. Loading of the hat 32 is performed by first placing the hat bill 34 atop the front portion of the baseplate 20 and then pushing the capturable portion 38 of the hat 32, which is the extreme forward portion of the crown of the hat and the front portion of the hat band, into the first forwardly opening gap 48 between the baseplate 20 and the print panel support plate 42. The print receiving area 30 of the hat 32 is then pulled rearwardly and downwardly atop the print panel support plate 42. The stretching insert 54 is then pushed against the fabric of the hat 32 just to the rear of the print receiving portion 30 into the second, rearwardly facing 50, shown in FIG. 6, to jam the part of the rearward portion 36 immediately behind the print receiving area 30 of the hat 32 into the second gap 50 as well, as illustrated in FIG. 9. The holddown bar 64 is then lifted free from the seating block 106. The hinge block 82 is then rotated in a counterclockwise direction about the vertical axis of rotation 74 from the position shown in FIG. 3. The swivel block 88 is then rotated about the horizontal axis of rotation 72, thereby swinging the holddown bar 64 into the engaged position illustrated in FIG. 8 where the distal end 68 of the holddown bar 64 is seated in the V-shaped seat 98 in the cradle 94, where it is held in place by engagement of the tooth 104 of the catch retainer 100, as illustrated in FIG. 8.

Once the next hat 32 to be printed is loaded onto the transportable platen 16, as illustrated in FIG. 8, the transportable platen 16 is lifted clear from the unloading and loading station 114 and moved back to the position located directly above the platen support 14, as illustrated in FIG. 14. The transportable platen 16, loaded with the hat 32 to be printed, is then lowered onto the platen support 14 from the position shown in FIG. 14 to the position shown in FIG. 10. As the platen 16 is lowered onto the platen support 14, the guide strips 26 slide down alongside the lateral sides of the platen support 14 and the registration projection pins 108 slide vertically into the registration apertures 110 in the slab 140, as illustrated in FIG. 10. Once the transportable platen 16 has been positioned atop the platen support 14, as illustrated in FIG. 10. The hat 32 is then ready to receive imprintation. The operator of the digitized printing machine 10 merely presses the conventional arm retraction button on the console 11 so that the garment receiving arm 12 retracts and is drawn forwardly into the printing position beneath the inkjets of the garment printing machine 10.

The entire process of withdrawing the transportable platen 16 with the printed hat 32 thereon from the platen support 14, placing it next to the garment transfer unloading and loading station 114, lifting a second platen 16 with the next hat 32 preloaded thereon from the garment transfer unloading and loading station 114 and moving it on to the platen support 14, takes only about four seconds.

That is, it takes only about four seconds from the time the garment receiving arm 12 moves rearwardly to bring the printed hat 32 into the position illustrated in FIG. 2 to the time a second duplicate transportable platen 16 with the next hat 32 to be printed thereon is in position as illustrated in FIG. 2.

It takes about 16 seconds to place the platen with the printed hat 32 on it onto the master unloading and reloading station 114, remove the printed hat 32 from that transportable platen 16, and load the next hat 32 to be printed thereon. However, unlike prior garment printing systems, the printing machine 10 is not idle during this time. To the contrary, while the operator is exchanging the printed hat for the next hat to be printed on one transportable platen 16 at the garment transfer unloading and loading station 114, the printing machine 10 is engaged in the process of printing an image on the hat 32 located atop an identical platen 16 within the printing machine 10. The printing process itself takes approximately 30 seconds. Consequently, the next hat 32 to be imprinted is positioned on one of the interchangeable platens 16 and that loaded transportable platen 16 is ready for placement on the platen support 14 well before the printing machine 10 extends the printing arm 12 for removal of the transportable platen 16 with the printed hat 32 thereon.

The time-saving achieved is approximately 12 seconds per hat 32. For a printing run of 1000 hats, therefore, the time-saving is about 200 minutes, well over three hours. Therefore, the present invention provides a very considerable savings in efficiency of printing garments.

Figure 18:
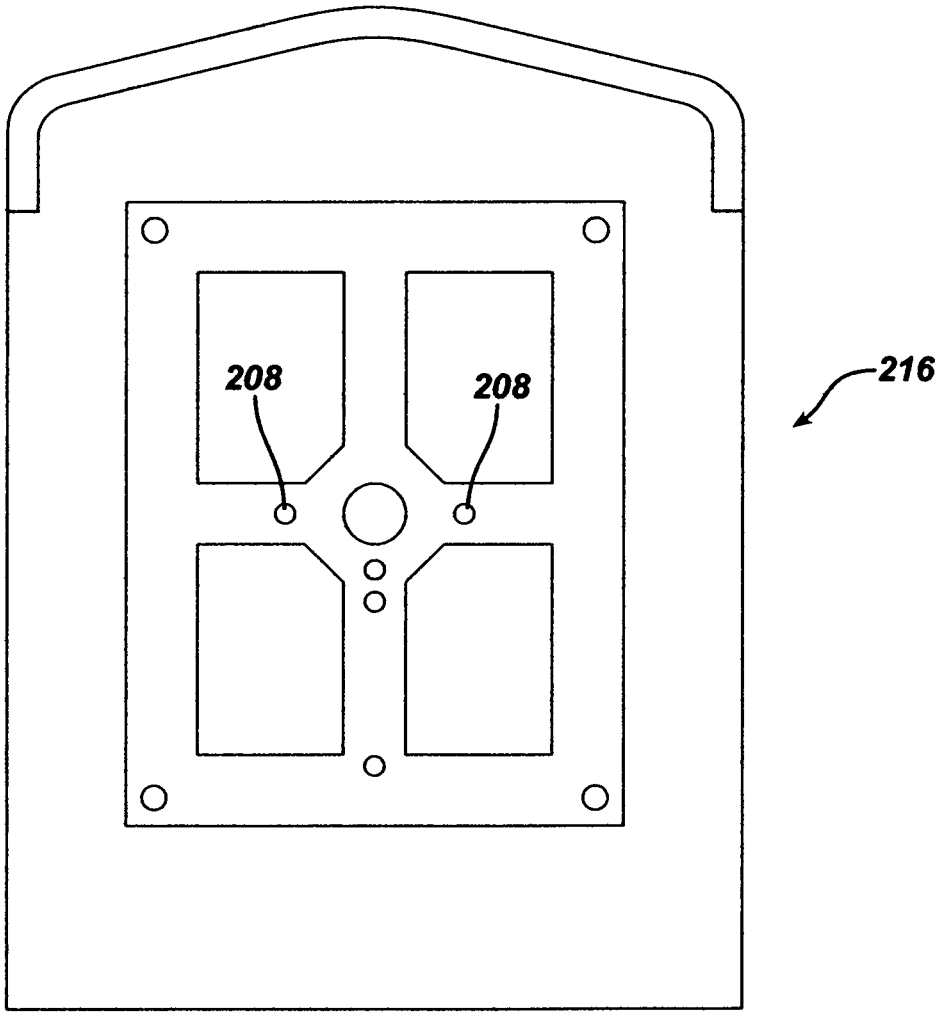
FIG. 18 is a bottom plan view of a platen constructed according to the invention suitable for receiving thereon a shirt to be imprinted using the digitized garment printing machine shown in FIGS. 1 and 2.

A transportable garment printing platen in accordance with the invention may be utilized to print garments other than hats. FIG. 18 illustrates the underside of a platen 216 suitable for mounting a shirt to be loaded thereon and imprinted using the digitized garment printing machine 10. Like the platen 16, the platen 216 includes a pair of registration pins 208 that fit into the corresponding registration apertures 110 in the platen support 14. A platen 216 may be loaded with the next shirt to be printed while an identical platen 216, previously loaded with a shirt to be printed, is already seated on the platen support 14 in the manner previously described.

Figure 19:
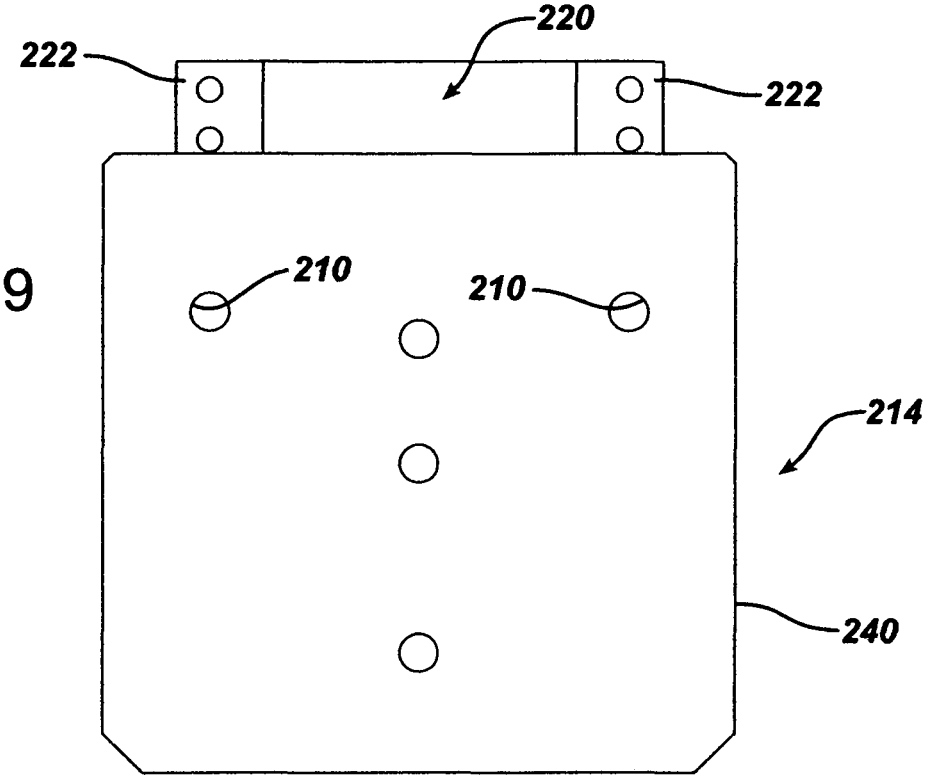
FIG. 19 is a top plan view of a platen support suitable for mounting on a garment receiving arm of a manual or automated screen printing machine.
Figure 20:
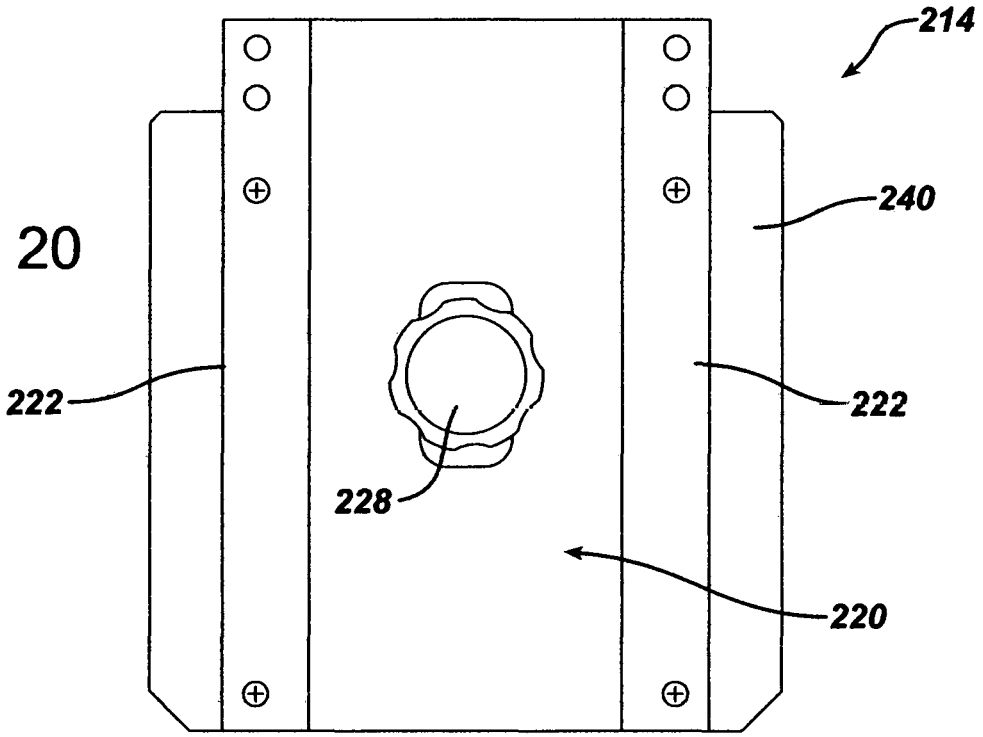
FIG. 20 is a bottom plan view of the platen support illustrated in FIG. 19.
Figure 21:
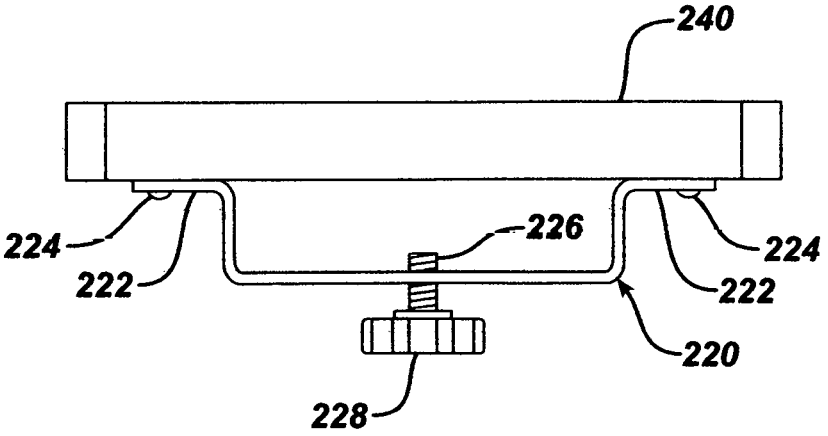
FIG. 21 is an end elevational view of the platen support illustrated in FIG. 19
Figure 22:
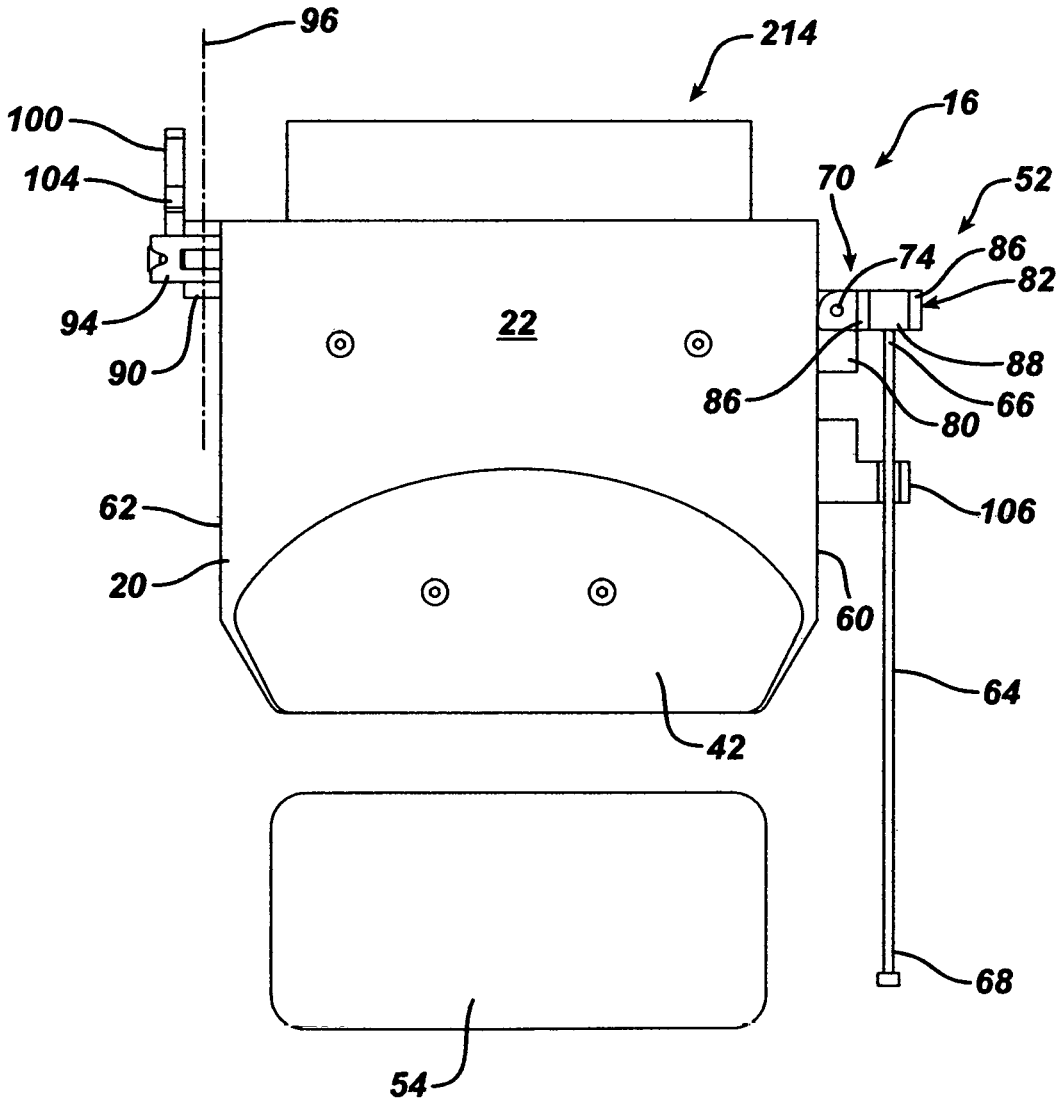
FIG. 22 is a top plan view of the platen illustrated in FIG. 3 mounted upon the platen support illustrated in FIG. 19.

The transportable platen 16 of the invention may also be utilized with garment screen printing machines as well as garment digitized printing machines. FIGS. 19-21 illustrates a platen support 214 adapted to receive and seat the transportable platen 16 previously described. The platen support 214 illustrated in FIG. 19 has a platen support slab 240 having an outer perimeter identical to that of the platen support slab 140 illustrated in FIG. 11. Registration apertures 210 in the platen support slab 214 shown in FIG. 19 are likewise spaced apart the same distance and in the same corresponding locations as the platen registration pin apertures 110 in the platen support slab 140 illustrated in FIG. 11.

Figure 24:
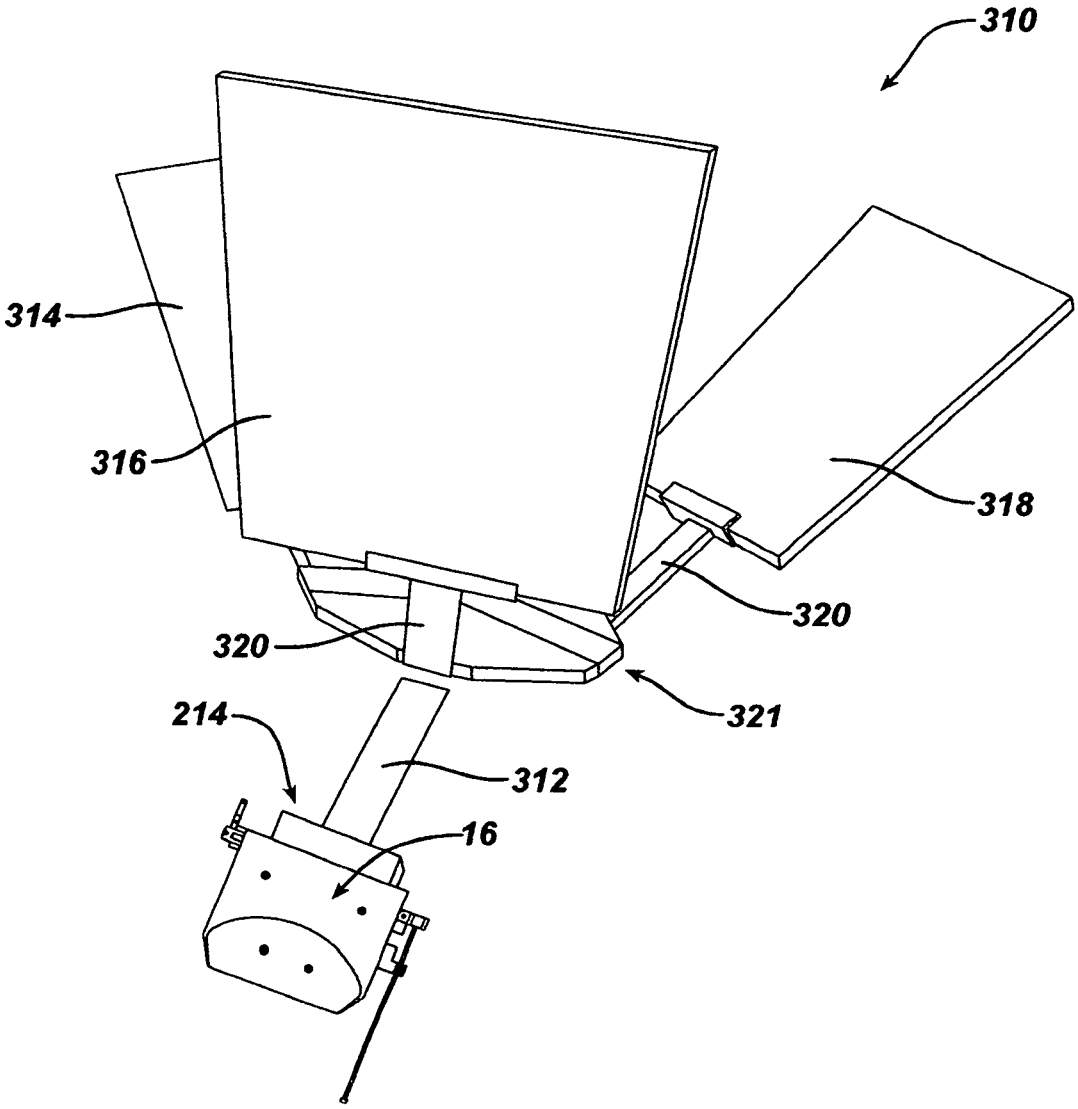
FIG. 24 PRIOR ART
FIG. 24 is a perspective view of a conventional manual screen printing machine shown with the platen and platen support illustrated in FIG. 22 mounted on the screen printing machine garment receiving arm.

The attachment mechanism for securing the platen support 214 is somewhat different, however, due to the difference in design of garment receiving arms on a screen printing machine from those on a digitized garment printing machine 10. FIG. 24 illustrates a typical, screen printing machine 310 that has a garment receiving arm 312 upon which the transportable platen 16 may be mounted. The manual garment printing machine 310 may, for example, be a Workhorse Odyssey 0-4100B or a M & R Sidewinder manual rotary screen printing machine. However, the apparatus and method of the invention may be utilized with virtually all conventional, commercially available, manual screen printing machines.

The screen printing machine 310 has different screens, three of which are illustrated at 314, 316 and 318 each mounted on a screen carrying arm 320. The arms 320 are mounted upon a hub or turntable 321 and may be independently rotated downwardly toward the platen 16 from the positions illustrated in FIG. 24. Each of the screens 314, 316 and 318 is sequentially brought into alignment with the platen 214, and is rotated downwardly into contact with a garment mounted on the platen 16 to imprint that garment with a particular color once the turntable 321 advances it into alignment with the garment receiving arm 312. The operation of the screen printing machine 310 is conventional and need not be described in detail.

FIG. 24 illustrates the transportable platen 16 removably positioned upon the platen support 214. As previously noted, the platen support 214 has the same seating arrangement for receiving the transportable platen 16 as the platen support 14. However, the connection of the platen support 214 to the garment receiving arm 312 is adapted to the connection arrangement for a typical screen printing machine 310.

Figure 23:
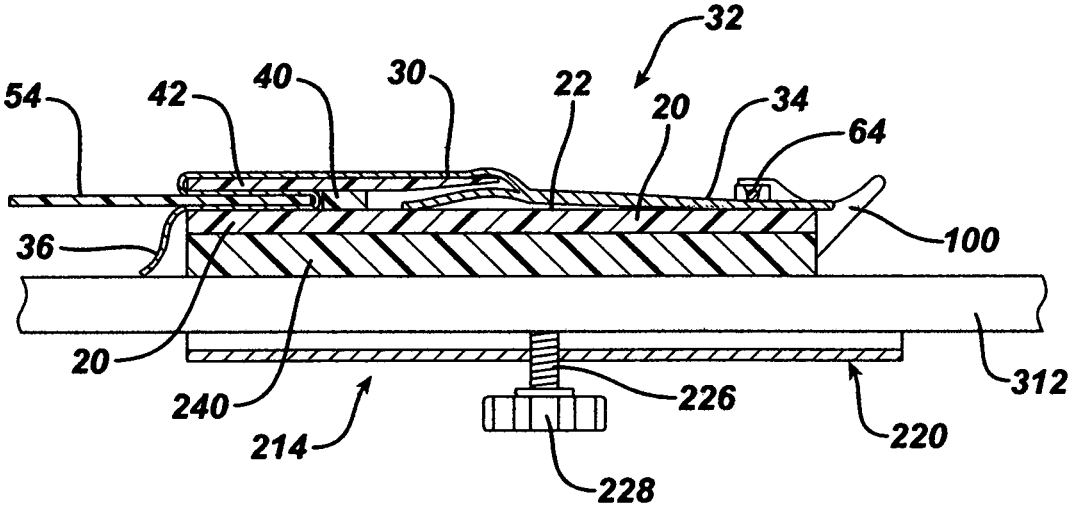
FIG. 23 is a sectional elevational view of the platen shown in FIG. 14 with a hat loaded thereon positioned atop the platen support illustrated in FIGS. 19-21.

More specifically, as illustrated in FIGS. 21 and 23, a section of a U-shaped channel 220 having outwardly turned side flanges 222 is secured to the underside of the platen support slab 240. Attachment of the flanges 222 to the underside of the slab 240 is by means of bolts or screws 224. The channel 220 thereby defines an open space between its central portion and the underside of the slab 240 that allows the platen support 214 to be mounted upon the garment receiving arm 312. A setscrew 226 is threadably engaged in a threaded aperture in the channel 220 to allow the setscrew 226 to be advanced or withdrawn by rotation of a tightening knob 228. As illustrated in FIG. 23 the platen support 214 is clamped at the appropriate position along the length of the garment receiving arm 312 by tightening the clamping screw 226 using the tightening knob 228. This places the platen support 214 at the correct position to receive an imprint of ink through the screens 314, 316 and 318 at the unmasked locations thereon. The transportable platens 16 are unloaded and loaded at the garment unloading and loading station 114 and lifted from and replaced onto the platen support 214 in the same manner as described with respect to the platen 16 and platen support 14.

It should be noted that when the platen 16 is utilized with the screen printing machine 310 illustrated in FIG. 24, the holddown bar 64 is not engaged in the manner illustrated in FIG. 8, but to the contrary is moved to its disengaged position illustrated in FIG. 24. Furthermore, the catch 100 is not moved to its simple disengaged position illustrated in phantom at 100" in FIG. 6, but to the contrary is moved to its fully lowered, dangling position indicated at 100 in FIGS. 4 and 6.

The reason for not deploying of the holddown rod 64 and for lowering the catch 100 so that it does not project above the top surface of the baseplate 20 is because unlike use of inkjets with a digitized printing machine 10, the screens 314, 316 and 318 are lowered into direct contact with the print receiving surface of a garment. As a consequence, no portion of the structure of the transportable platen 16, other than the print panel support plate 42, should project above the upper surface 22 of the baseplate 20. Such an upward projection could prevent the print screen from making full contact with the print receiving surface 30.

Platens suitable for use in printing on shirts, operating on the same principles, but with a somewhat different construction are also within the scope of the present invention. For example, FIGS. 25-31 illustrate a platen 416 constructed according to the invention, but suitable for holding a shirt, rather than a hat, for printing. The garment mount 418 is comprised of a flat, generally rectangular plexiglass baseplate 420 measuring about 16 inches in length and 14 inches in width. The baseplate 420 has a flat upper surface 422 and a lower surface 424. The garment mount 418 also includes a print panel support plate 442 having a flat upper surface 446 forming the upwardly facing garment support surface. The garment mount 418 is further comprised of a spacing mechanism in the form of a laterally extending spacing strip 440 that is interposed between the baseplate 420 and the print panel support plate 442 at the rearward ends thereof. The spacing strip 440 creates a gap 450 between the print panel support 442 and the upper surface 422 of the baseplate 420. The garment mount 418 is further comprised of a pair of mutually parallel, longitudinally extending guide strips 426 that are secured to the lower surface 424 of the baseplate 420.

Figure 35:
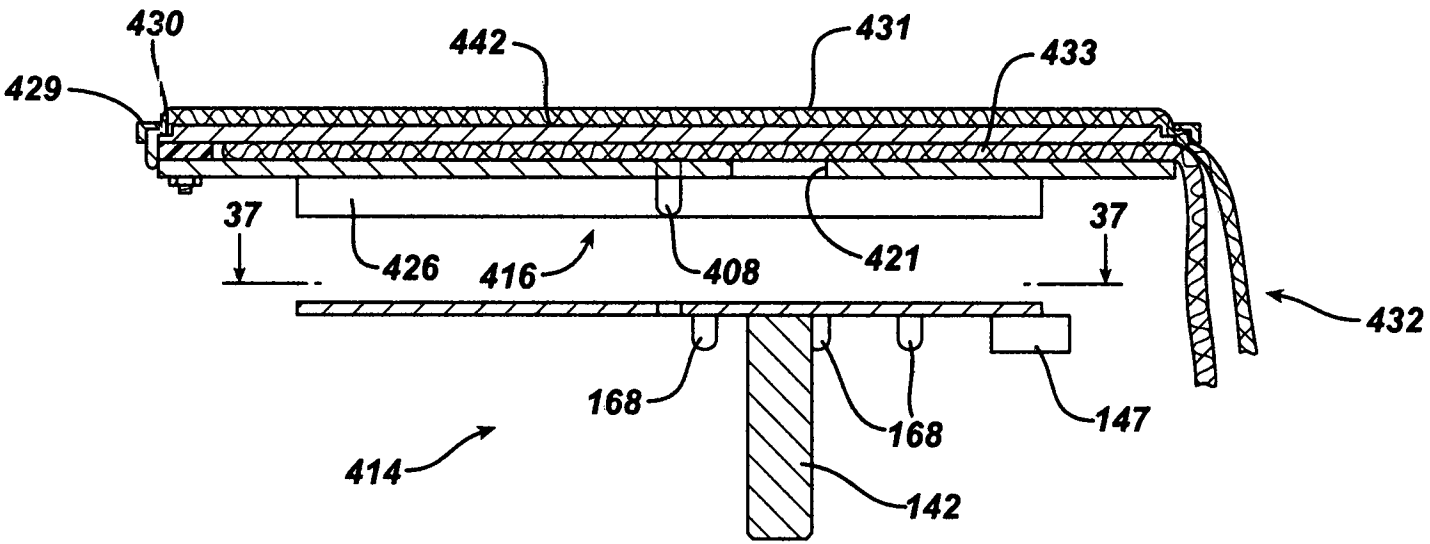
FIG. 35 is a sectional elevational view of the platen shown in FIG. 25 with a shirt loaded thereon positioned above but disengaged from an alternative embodiment of a platen support configured to receive the platen of FIG. 25 and which is adapted for use with the digital printing machine illustrated in FIGS. 1 and 2.
Figure 36:
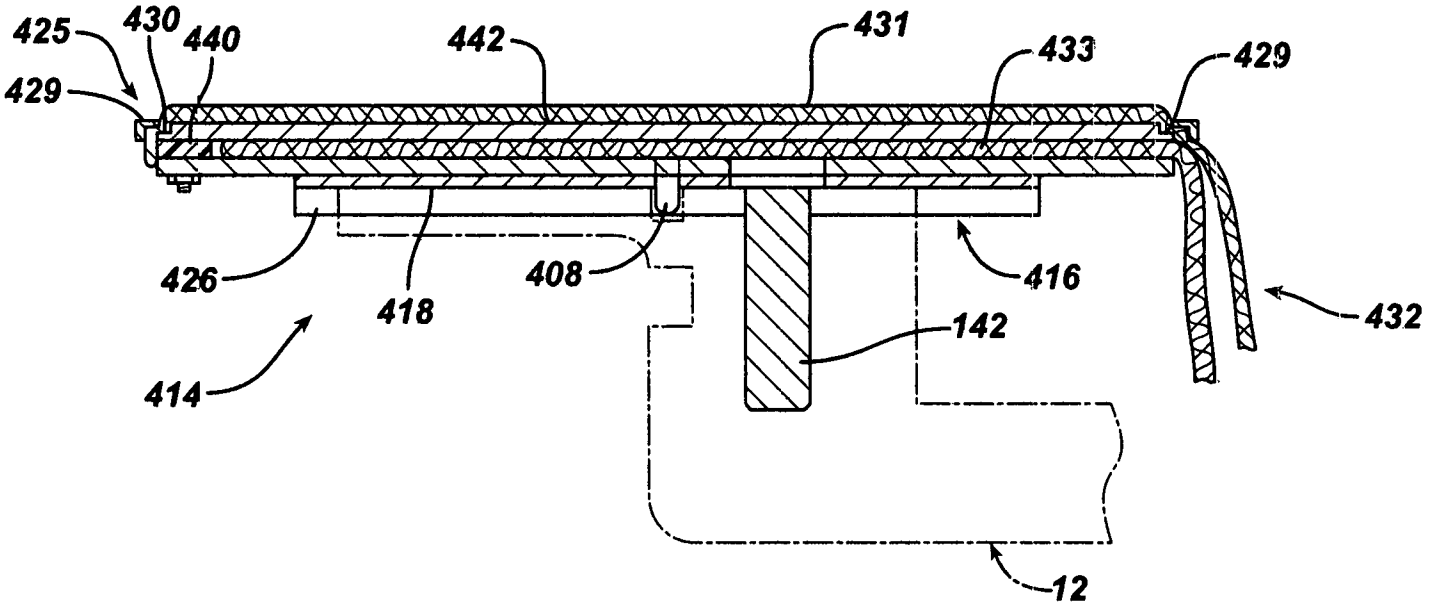
FIG. 36 is a sectional elevational view of the loaded platen of FIG. 35 dropped onto and engaged with the platen support shown in FIG. 35 with the garment receiving arm of the digital printing machine of FIGS. 1 and 2 shown in phantom.
Figure 37:
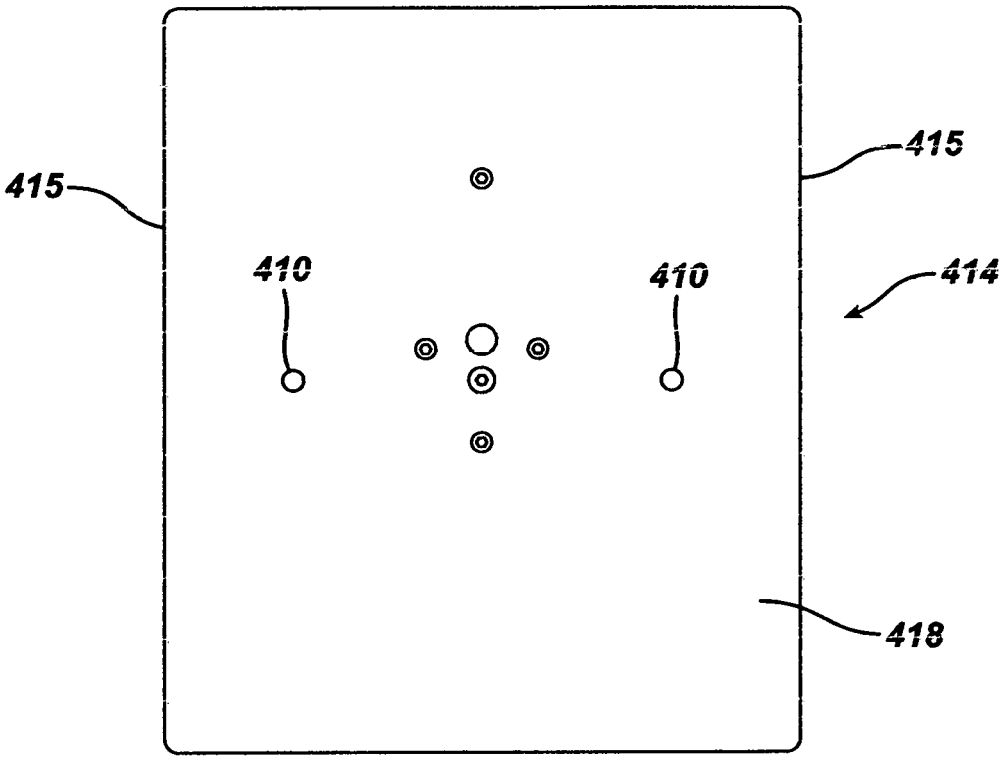
FIG. 37 is a top plan view of the platen support taken along the lines 37-37 in FIG. 35.

A platen support 414 is illustrated in FIGS. 35-37. The platen support 414 has a top plate or slab 418 of a generally rectangular shape that is approximately 12 inches in length and 10 inches in width The top plate 418 of the platen support 414 has mutually parallel side edges 415 so that the platen support 414 has a uniform width along its length. Therefore, when the platen 416 is lowered onto the platen support 414 the guide strips 426 reside alongside the side edges 415 of the top plate 418 of the platen support 414. This prevents relative movement in a lateral direction between the platen 416 and the platen support 414. As with the platen 16, a pair of registration positioning pins 408 project from the underside of the platen support baseplate 420. These positioning pins 408 fit snugly into at least two of the positioning apertures 410 defined in the platen top mounting plate or slab 418 of the platen support 414.

Figure 28:
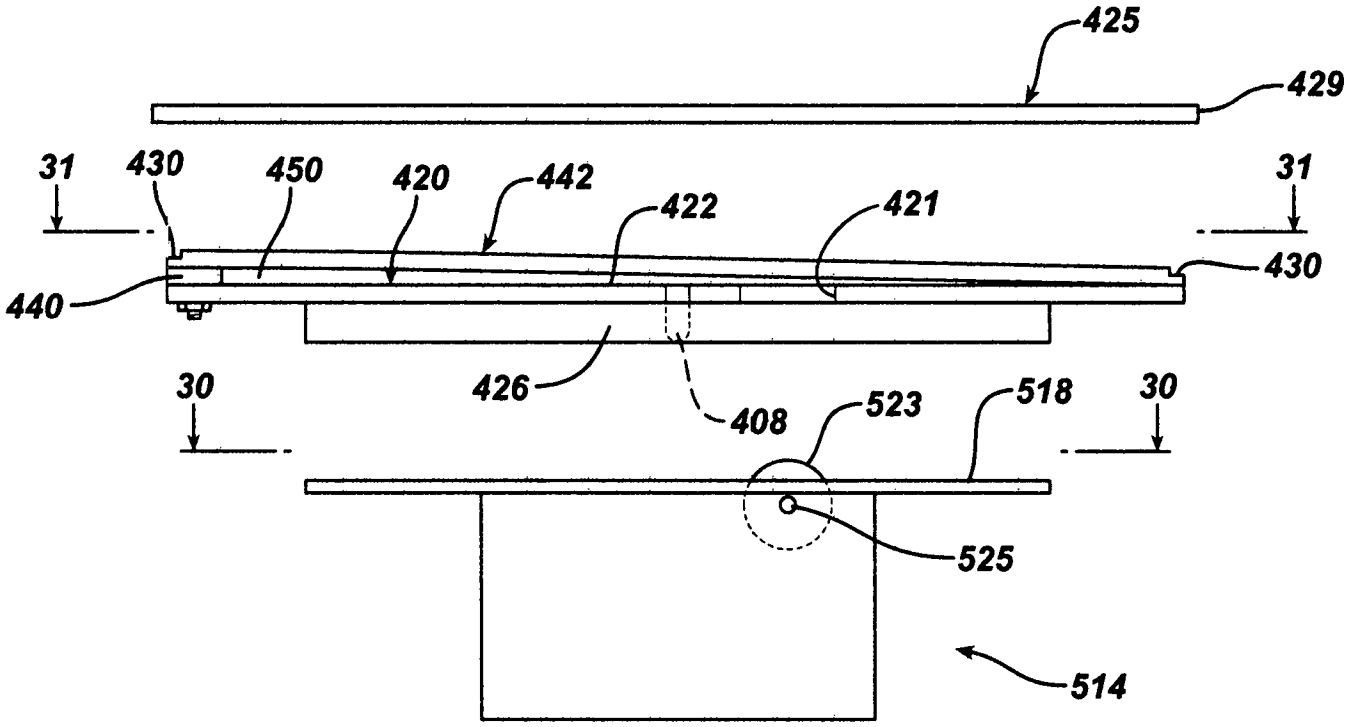
FIG. 28 is an exploded side elevational view showing the transportable platen of FIG. 25 located above a different embodiment of a master garment unloading and loading station constructed according to the invention.
Figure 29:
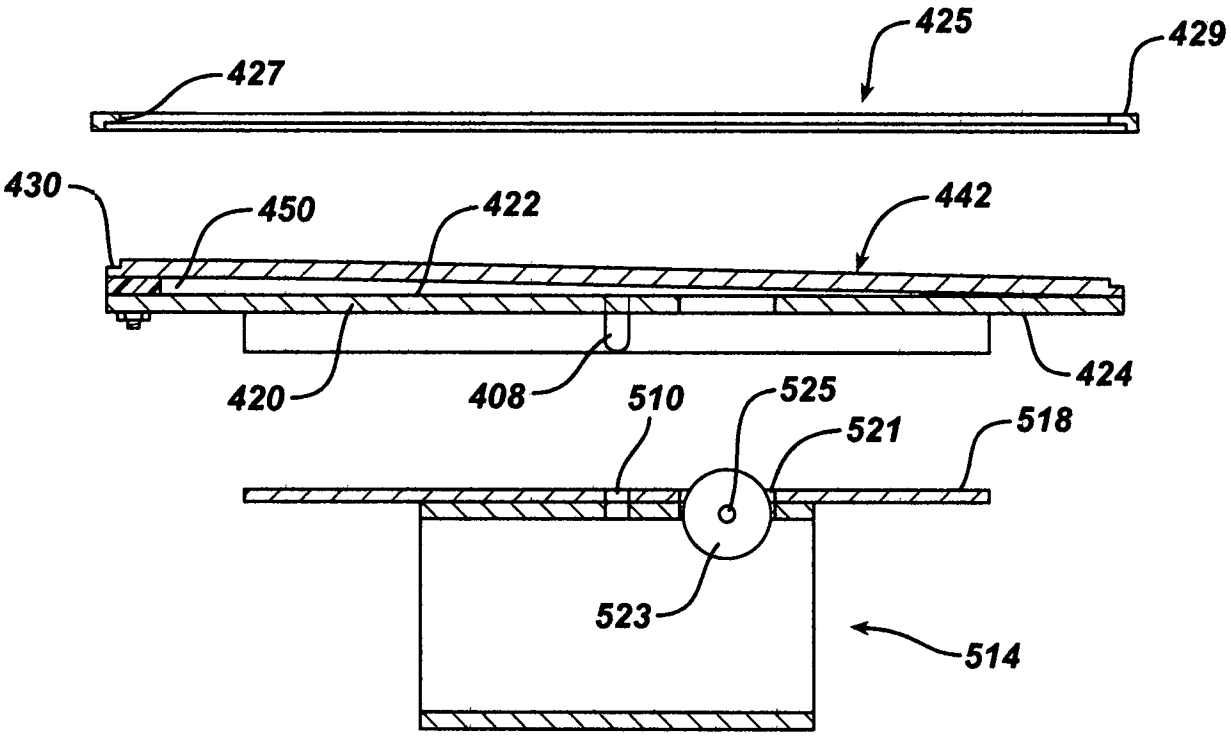
FIG. 29 is an exploded sectional elevational view of the platen and master garment unloading and loading station illustrated in FIG. 28
Figure 30:
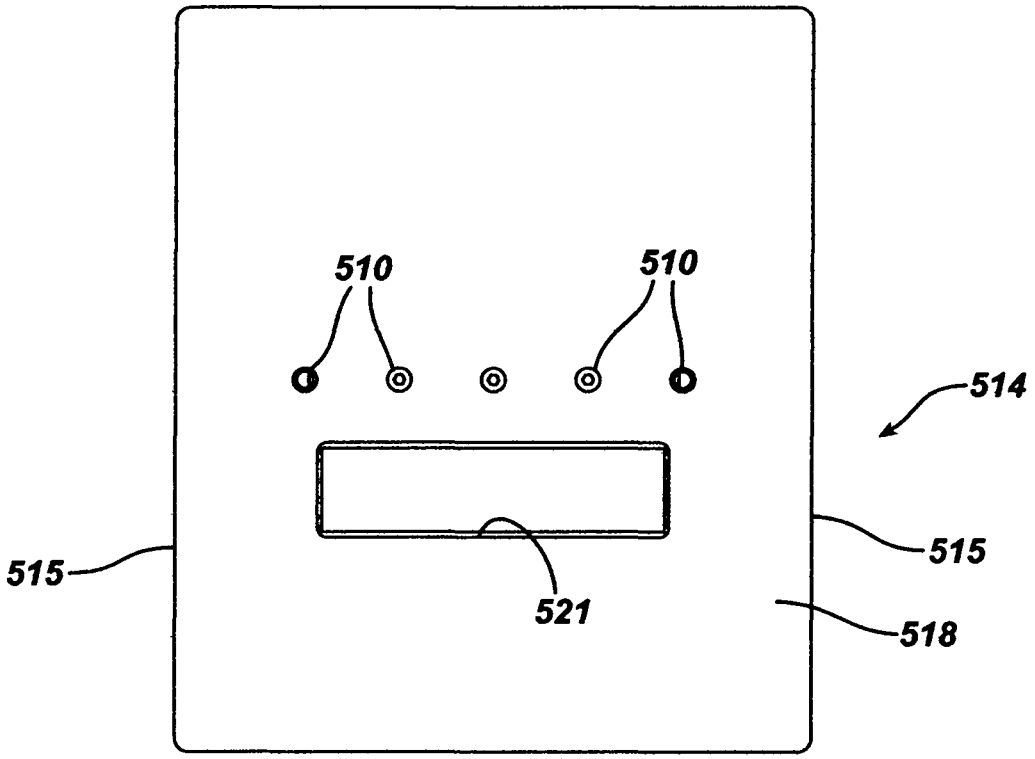
FIG. 30 is a top plan view taken along the lines 30-30 in FIG. 28.
Figure 31:
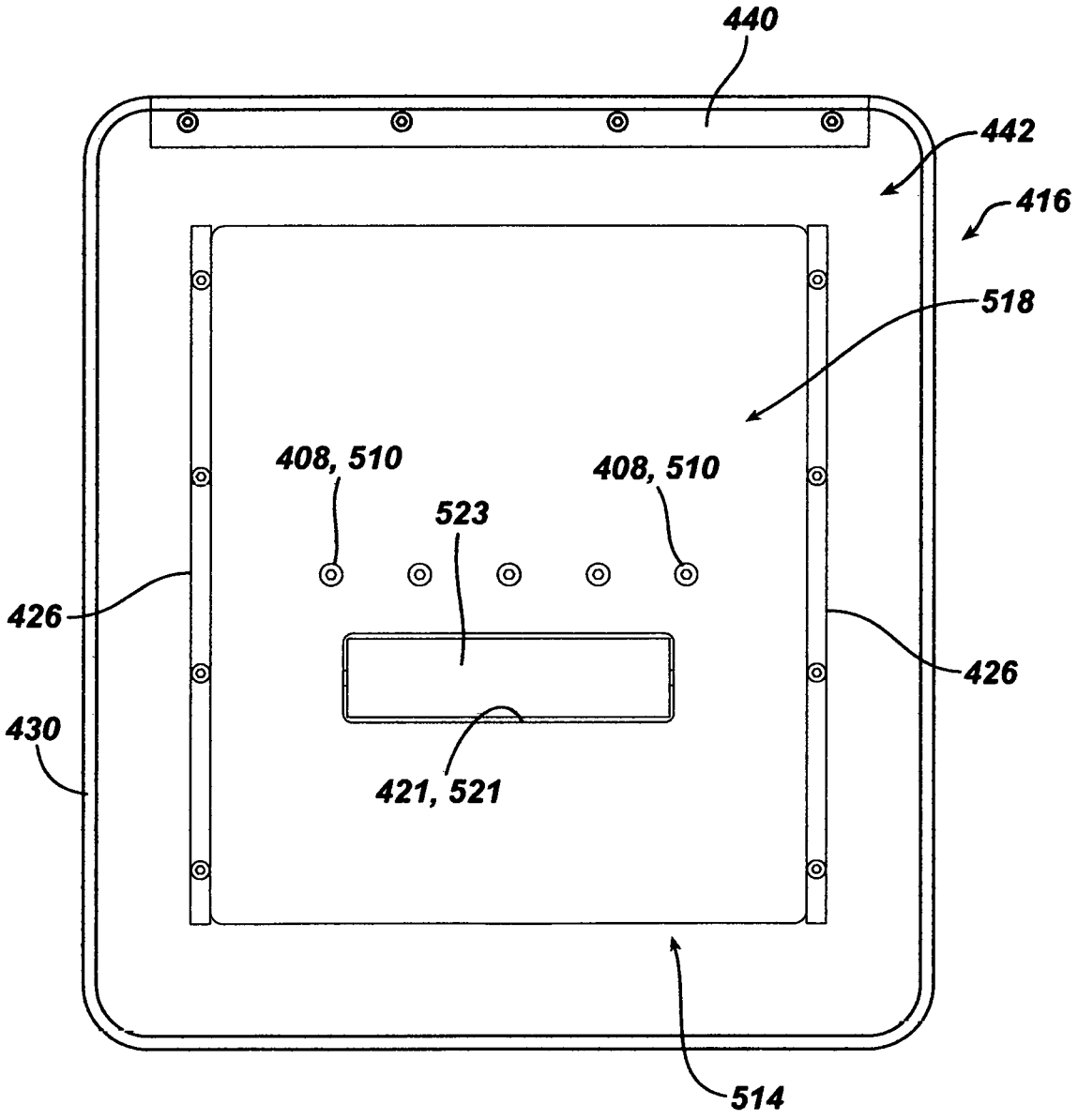
FIG. 31 is a top plan view taken along the lines 31-31 in FIG. 28
Figure 32:
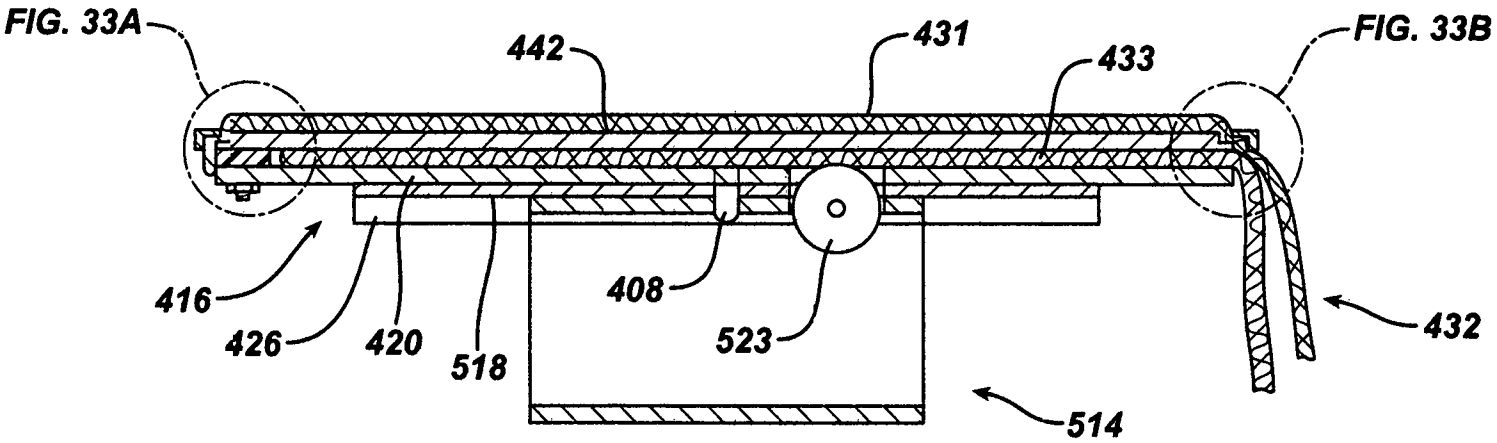
FIG. 32 is a side sectional view showing the platen with a shirt loaded thereon and engaged atop the master unloading and loading station of FIG. 28.
Figure 33A:
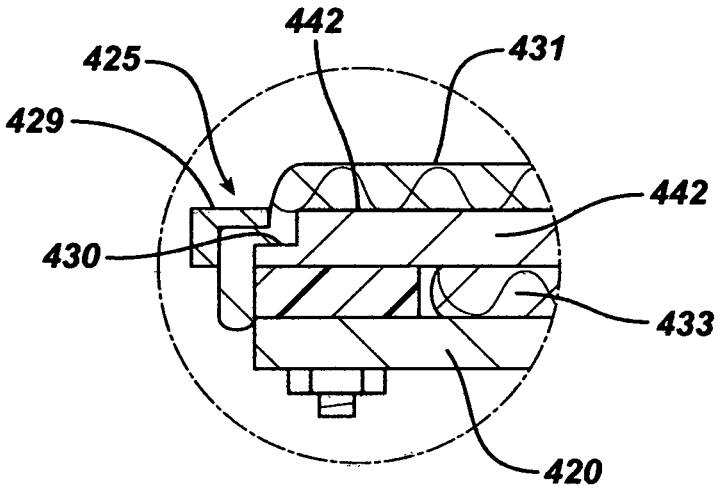
FIGS. 33A and 33B show enlarged detailed portions of the platen loaded with a shirt where indicated at 33A and 33B in FIG. 32.
Figure 33B:
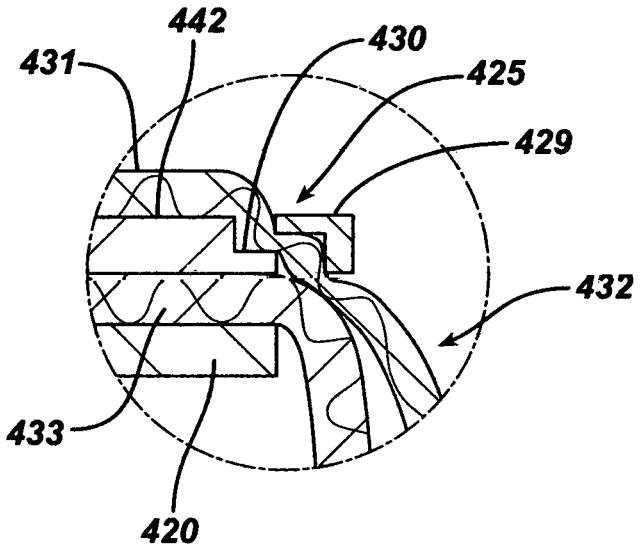
Figure 34:
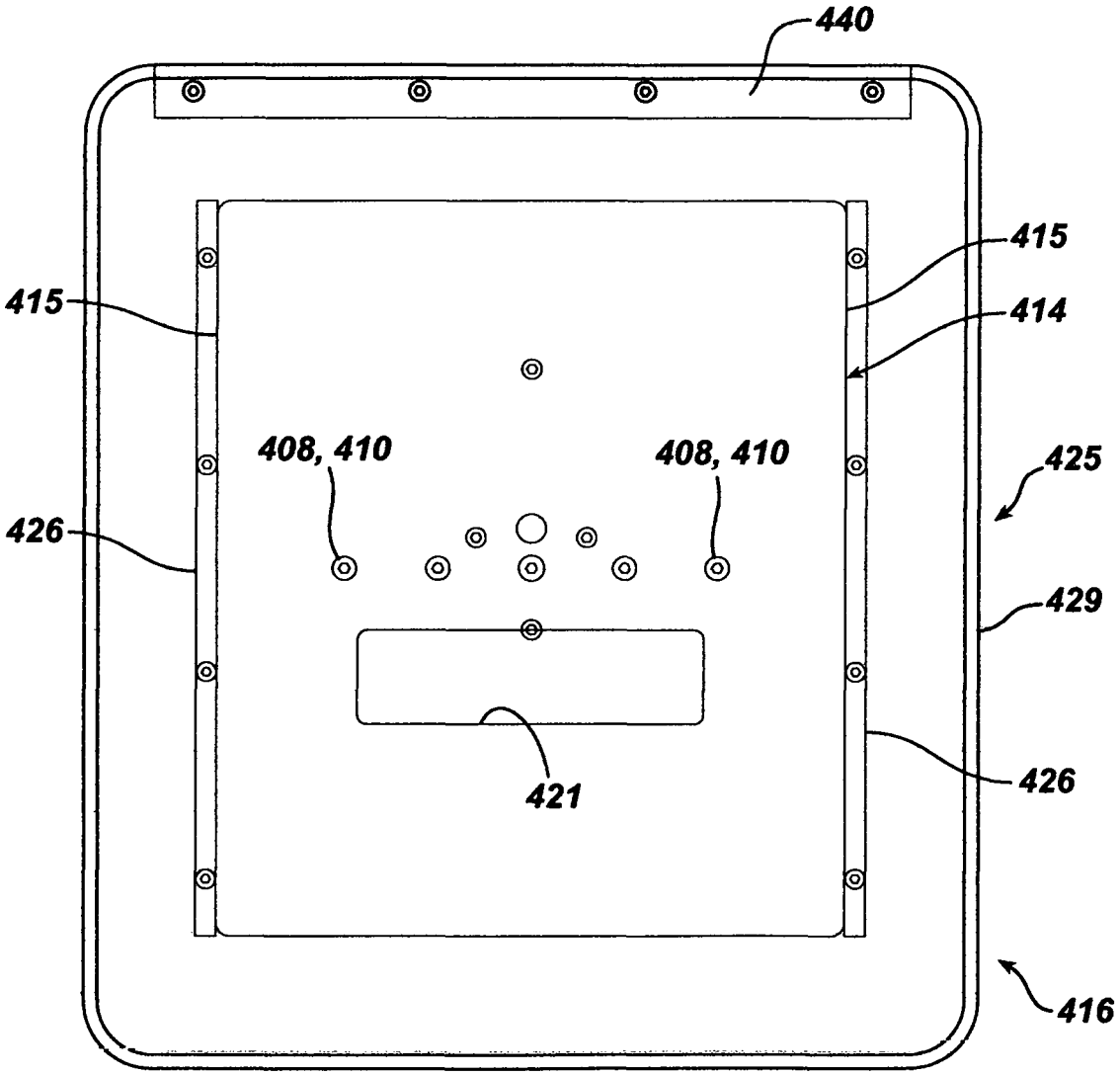
FIG. 34 is a top plan view of the platen illustrated in FIG. 25 before mounting of the garment depressing frame thereon.

As with the transportable platen 16, there is a master garment loading and unloading station 514 for the platen 416, illustrated in FIGS. 28, 29 and 32. The master garment loading and unloading station 514 includes an assembly platform 518 having at least one, and in the embodiment shown, a pair of vertically extending recesses which are apertures 510 defined therein. The apertures 510 are configured to receive the vertically extending projection pins 408 that depend from the undersurface of the platen baseplate 420 in mating engagement therewith.

The assembly platform 518 has side edges spaced apart a uniform distance equal to the width of the top plate or slab 418 of the platen support 414 so as to prevent lateral movement of the baseplate 420 of the platen 416 relative to the assembly platform 518. Lateral movement is prevented since the guide strips 426 depending from the underside of the baseplate 420 reside snugly against the outer side edges 515 of the assembly platform 518 so as to slidingly embrace the side edges 515 of the assembly platform 518 between them and laterally center the platen 416 relative to the assembly platform 518. The platen 416 is moved forwardly or rearwardly, if necessary, until the vertically extending projection pins 408 drop into the corresponding apertures 510 in the assembly platform 518 so that the platen 416 is seated upon the master garment loading and unloading station 514.

The master loading and unloading station 514 has a generally rectangular, laterally elongated window 521 defined through the assembly platform 518. A cylindrical roller 523 is mounted in the master loading and unloading station 514 for rotation about a horizontal, laterally extending axis of rotation 525. A portion of the roller 523 protrudes upwardly through the laterally extending window 521 and is freely rotatable relative to the master loading and unloading station 514.

The transportable platen 416 has a another feature that is not in the transportable platen 16. The platen baseplate 420 also has a generally rectangular, laterally elongated window 421 defined therethrough. The window 421 resides in vertical registration and congruent alignment with the window 521 in the assembly platform 518 when the platen 416 is seated atop the master loading and unloading station 514. The roller 523 also protrudes through the window 421 of the baseplate 420 as well as the window 521 of the assembly platform 518 when the platen 416 is positioned atop the assembly platform 518 and the vertically extending projections 408 protruding from the underside of the platen baseplate 420 reside in mating engagement with the vertically extending apertures 510 in the assembly platform 518.

The laterally extending spacing strip 440 is located at the rear end of the platen 416 and is thereby remote from the window 421 in the baseplate 420. As shown in FIGS. 28 and 29, the print panel support 442 is held above the platen baseplate 420 in cantilevered fashion on top of the spacing strip 440. As a consequence, gravity causes the forward end of the print panel support 442 to sag downwardly into contact with the upper surface 422 of the baseplate 420 when the transportable platen 416 is removed from the master loading and unloading station 514, as illustrated in FIG. 29.

Once a garment, such as a shirt 432, is mounted on the platen 416, the force of gravity causing the print panel support 442 to sag downwardly will tend to immobilize the shirt 432 relative to the platen 416. However, when the platen 416 is positioned atop the master loading and unloading station 514, the roller 523. while protruding through the window 421 defined through the baseplate 420, will press upwardly against the undersurface of the print panel support 442, thereby lifting the forward end of the print panel support 442 slightly up and out of contact with the baseplate 420. This facilitates the loading of a shirt 432 on to the platen 416.

More specifically, if an image is to be printed on the chest portion 431 of the shirt 432, the opposing back portion 433 of the shirt is inserted in between the baseplate 420 and the print panel support 442 at the forward end of the platen 416 remote from the spacing strip 440, as shown in FIG. 32. The chest portion 431 of the shirt resides atop the print panel support 442 and the back portion 433 of the shirt 432 is located between the print panel support 442 and the baseplate 420 while the platen 416 is seated atop the master garment loading and unloading station 514. The tail area of back portion 433 of the shirt 432 is pulled rearwardly in between the print panel support 442 and the baseplate 420 while the chest portion 431 of the shirt 432 resides atop the print panel support 442.

This action of pulling the shirt 432 from right to left, as viewed in FIG. 32 causes the roller 523 to rotate in a counterclockwise direction, as viewed in FIGS. 29 and 32 as the shirt 432 is pulled rearwardly toward the spacing strip 140. When the platen 416 is lifted up from the loading and unloading station 514, the upward force of the roller 523 on the underside of the print panel support 442 is removed, whereupon the forward end of the print panel support 442 drops downwardly, thereby exerting pressure on the back portion 433 of the shirt fabric. This pressure tends to prevent shifting of the shirt 432 on the platen 416.

Figure 25:
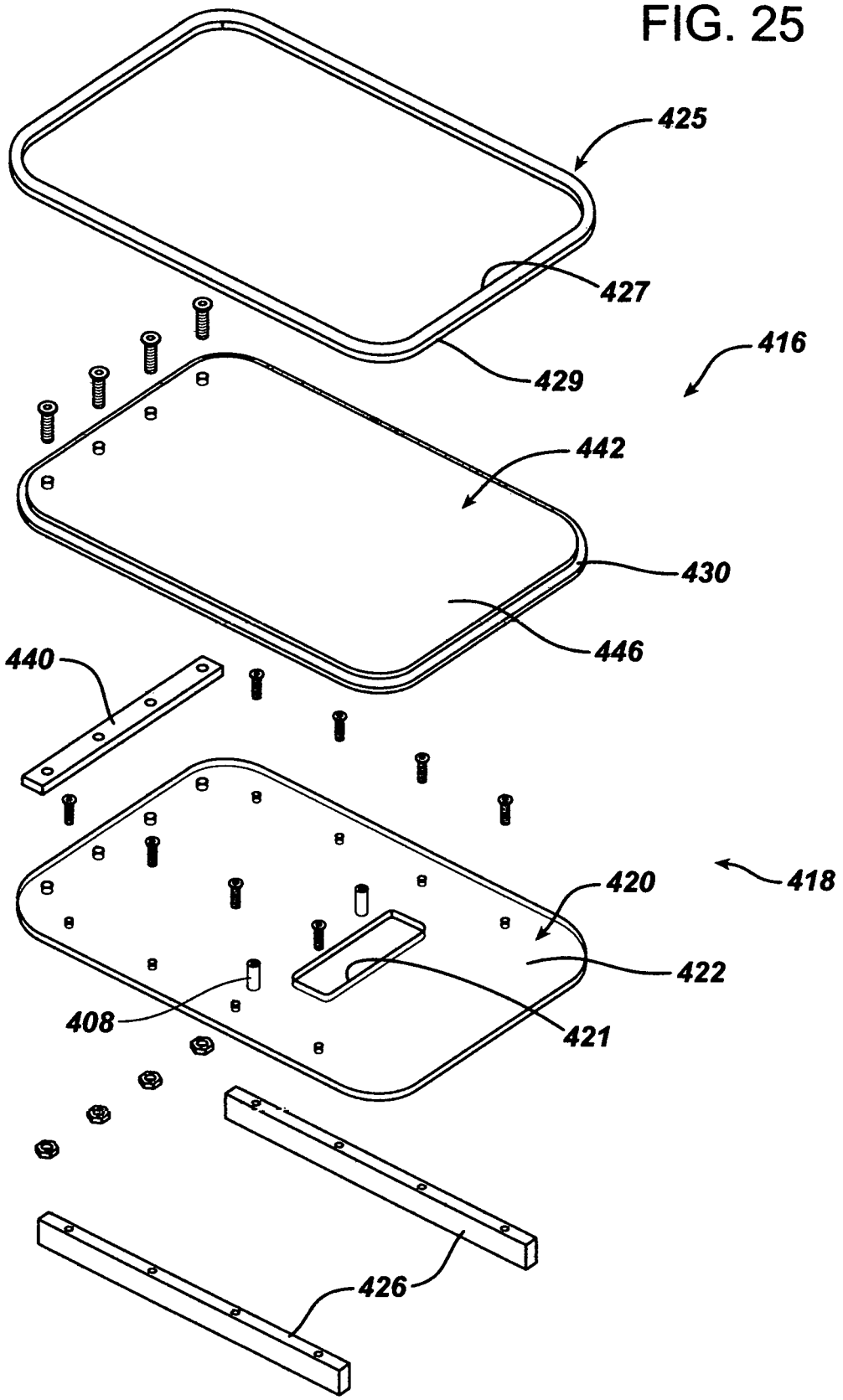
FIG. 25 is an exploded perspective view of an alternative embodiment of a transportable platen constructed according to the invention.
Figure 26:
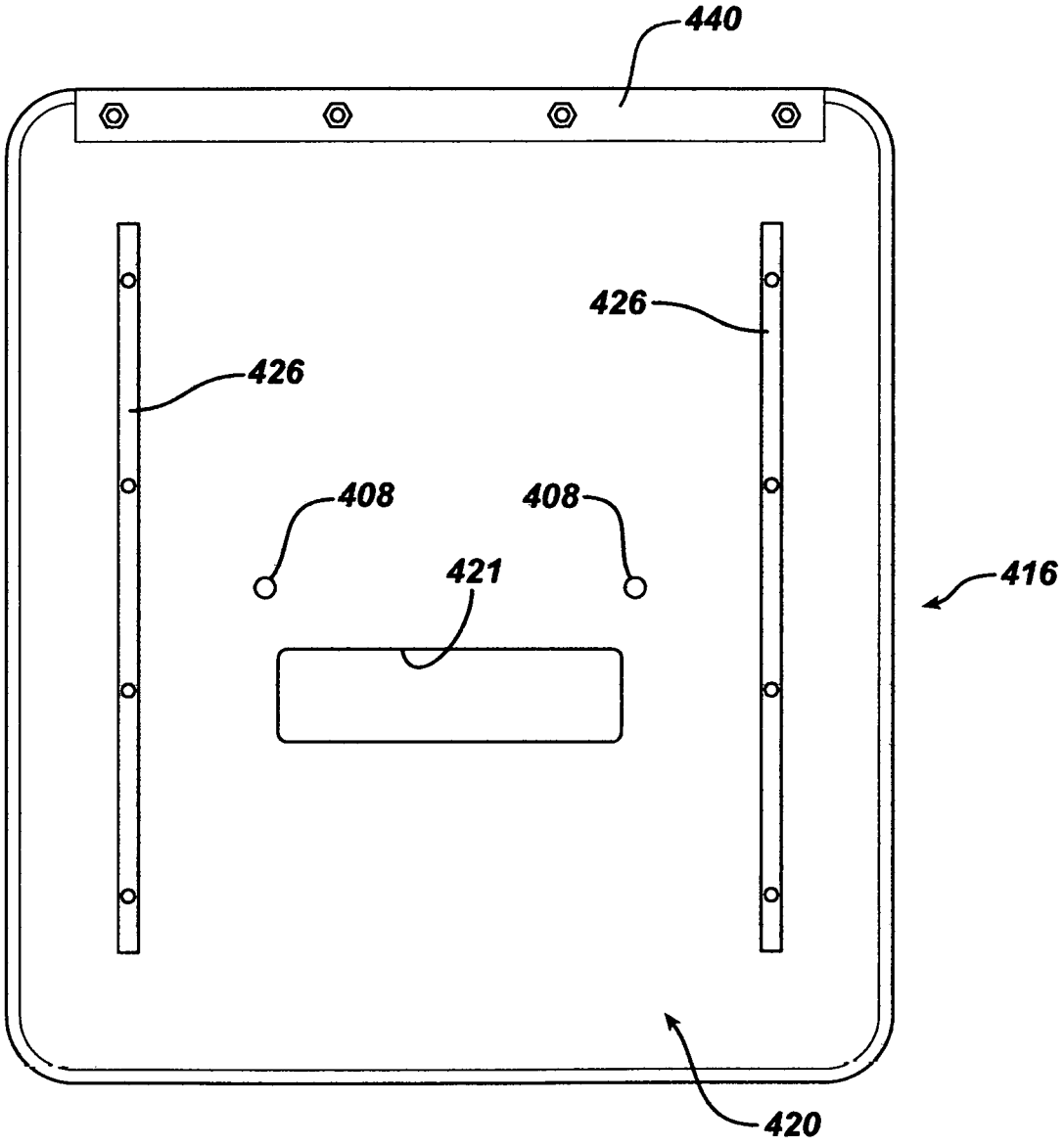
FIG. 26 is a bottom plan view of the transportable platen illustrated in FIG. 25
Figure 27:
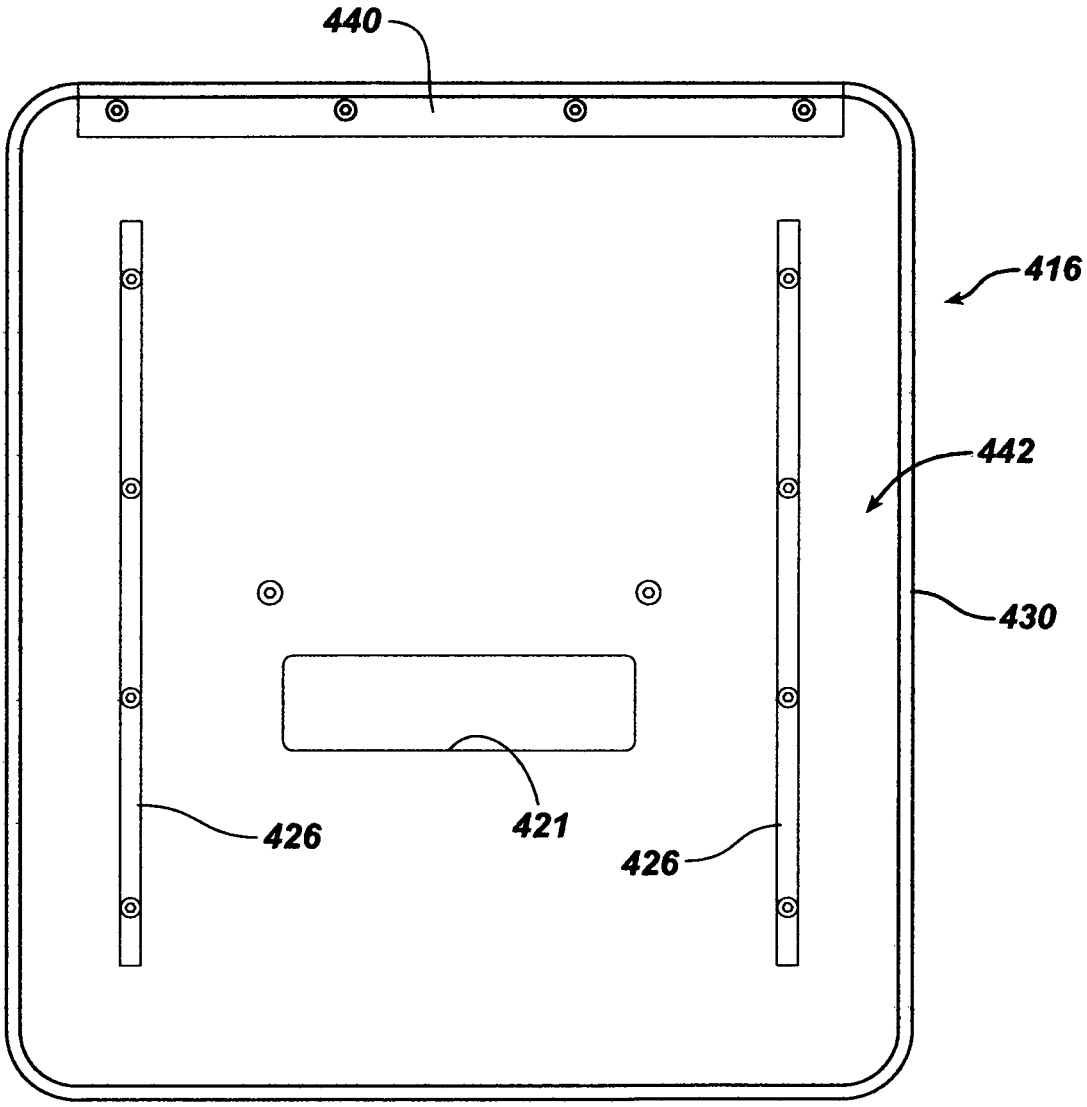
FIG. 27 is a top plan view of a transportable platen illustrated in FIG. 25

Even greater immobilization of the shirt 432 is provided by using an open frame 425, forming a part of the platen 416. The frame 425 may be lowered into position onto the print panel support 442. The frame 425 is illustrated in FIGS. 25, 29, 32, 35 and 36. The frame 425 has a large, central window opening 427 defined therein and a peripheral rim 429 having an L-shaped cross section, that resides above only the peripheral margin 430 of the print panel support 442. The peripheral margin 430 of the print support panel 442 is vertically recessed from the greater central area of the print panel support 442, as illustrated in FIGS. 25, 28 and 29. As a consequence, the rim 429 of the frame 425 bears down upon the fabric of the garment back 433 and against only the peripheral margin 430 of the print panel support 442.

The structure of the frame 425 therefore extends vertically no higher than the central region of the print support panel 442. Consequently, the frame 425 exerts an immobilizing force on the upwardly facing surface of the garment 432, but does not project above the print receiving surface of the garment 432. The frame 425 therefore does not project above the top surface of the print panel support 442 and therefore does not interfere with contact of the print screens 314, 316 and 318 against the print receiving chest portion 431 of the shirt 432 when the transportable platen 416 is used in the screen printing machine illustrated in FIG. 24. The frame 425 likewise does not interfere with any vertical adjustment of spacing between the print receiving surface portion 431 of the garment 432 and the inkjets at the printing station when the platen 416 is used with the digitized printing machine 10.

The transportable platen 416 is utilized with a platen support 414, illustrated in FIGS. 33-37. The platen support 414 has pin receiving recesses in the form of apertures 410. Like the platen support 14, the platen support 414 has registration pegs 168 depending from its underside. The pegs 168 cooperate with the elevation of adjusting mechanism 160 illustrated in FIGS. 15 and 16 in the manner previously described with reference to the platen support 14. The platen support 414 likewise has a central post 142 and a flange 147 that also cooperate with the coupling mechanism 148 illustrated in FIGS. 15 and 16.

The steps in loading and unloading shirts 432 using the platen 416 and the platen support 414 are quite similar to the steps employed in loading and unloading the platen 16. Specifically, one platen 414 is first positioned atop the garment mounting station 514. A portion 433 of a shirt 432 is pulled in between the platen baseplate 420 and the print panel support plate 442 while the portion 431 of the shirt to receive the imprint is pulled on top of the print panel support plate 442. Loading of the shirt 432 is from right to left, as viewed in FIG. 32.

At the start of operations, the platen support 414 is first positioned for a production run relative to the garment receiving arm 12 of the digitized printing machine 10 by adjusting the elevation adjusting mechanism 160, and by locking the set screw 146 against the flat 144 of the central post 142 of the platen support 414.

Once the handle 164 has been rotated to raise or lower the pegs 168 to the desired elevation, the set screw 146 is locked by clockwise rotation of the set screw handle 174. Once the handle 174 has locked the set screw 146 against the flat 144 of the center post 142, the platen support 414 is totally immobilized relative to the coupling mechanism 148 which is secured to the longitudinally projecting rear end of the garment receiving arm 12 of the digitized printing machine 10, as illustrated in FIG. 14. The platen support 414 is thereby immobilized from movement relative to the garment supporting arm 12 in all directions other than vertical.

The platen 416 of the present invention, however, is transportable and may be quickly and easily removed from the platen support 414 when the garment receiving arm 12 is extended as shown in FIGS. 2, 15 and 16.

To commence a printing run an unloaded platen 416 is first positioned onto the master garment transfer unloading and loading station 514 by simply positioning the platen 416 above the master garment transfer unloading and loading station 514, as illustrated in FIG. 29, and lowering it on to the master garment transfer unloading and loading station 414. As the transportable platen 416 is lowered onto the master garment transfer unloading and loading station 514, guide strips 426 slide down along the side edges of the loading platform 518 to laterally center the transportable platen 416 relative to the loading platform 518. The registration projection pins 508 then slide smoothly into the positioning apertures 510 in the loading platform 518 so that the transportable platen 416 is immobilized from horizontal movement relative to the master transfer unloading and loading station 514, as shown in FIG. 32.

For the first shirt 432 to be printed, the transportable platen 416 is initially empty. However, for all subsequent shirts the transportable platen 416 will bear a printed shirt 432. The shirt 432 on the transportable platen 16 that has just been removed from the platen support 414 will bear an imprintation.

Once the transportable platen 416 is seated atop the master transfer unloading and loading station 514, the frame 425 is lifted upwardly, free from the printed shirt 432 and also the print panel support plate 442. The printed shirt 432 is then pulled free from the print panel support plate 442 and the baseplate 420 by pulling it off the platen 416 from left to right, as viewed in FIG. 32. The roller 425 rotates clockwise as viewed in FIG. 32 and facilitates withdrawal of the printed shirt 432. The printed shirt 432 is then unloaded by removing it entirely from the transportable platen 416 and transferring it to a conveyor that carries it through a dryer.

The next shirt 432 to be printed is then loaded onto the transportable platen 416 while it remains seated atop the garment transfer unloading and loading station 514. The shirt is pulled onto the print panel support plate 442 from right to left, as viewed in FIG. 32. The shirt portion 431 to be printed resides atop the print panel support plate 442, while the opposite portion 433 is sandwiched in between the print panel support plate 442 and the baseplate 420. The roller 425 rotates in a counterclockwise direction, as viewed in FIG. 32, and facilitates loading of the shirt 432. Once the shirt 432 has been loaded the immobilizing frame 425 is then lowered into position atop periphery of the print receiving portion of the chest area 431. The rim 429 of the frame 425 bears downwardly against the shirt fabric and against the peripheral margin 430 of the print panel support plate 442.

Once the next shirt 432 to be printed is loaded onto the transportable platen 416, as illustrated in FIG. 32, the transportable platen 416 is lifted clear from the unloading and loading station 514 and moved back to the position located directly above the platen support 414, as illustrated in FIG. 35. The transportable platen 416, loaded with the shirt 432 to be printed, is then lowered onto the platen support 414 from the position shown in FIG. 35 to the position shown in FIG. 36. As the platen 416 is lowered onto the platen support 414, the guide strips 426 slide down alongside the lateral side edges 415 of the platen support 414 and the registration projection pins 408 slide vertically into the registration apertures 410 in the top slab 418, as illustrated in FIG. 36. Once the transportable platen 416 has been positioned atop the platen support 414, as illustrated in FIG. 36. The shirt 432 is then ready to receive imprintation. The operator of the digitized printing machine 10 merely presses the conventional arm retraction button on the console 11 so that the garment receiving arm 12 is drawn forwardly into the printing position beneath the inkjets in the console of 11 of the garment printing machine 10.

The entire process of withdrawing the transportable platen 416 with the printed shirt 432 loaded thereon from the platen support 414, placing it on the garment transfer unloading and loading station 514, unloading and removing the printed shirt 432, reloading the transportable platen 416 with the next shirt 432 to be printed, lifting the platen 416 from the garment transfer unloading and loading station 514 and returning it to the platen support 414, takes only about four seconds.

Undoubtedly, numerous variations and modifications of the invention will become readily apparent to those familiar with garment printing. Accordingly, the scope of the invention should not be construed as limited to the specific embodiments depicted and the method of implementation described, but rather is defined in the claims appended hereto.

We claim:

1. A mechanism for a garment printing machine having at least one horizontally extending garment receiving arm comprising: a platen support on said garment receiving arm and a transportable platen freely removable from said platen support, wherein said transportable platen is comprised of a horizontally extending garment mount having a flat, horizontal upwardly facing support surface, said mount further including an apparatus for immobilizing at least a print receiving portion of a garment positioned thereon relative to said transportable platen and for urging said print receiving portion of said garment into contact with said upwardly facing support surface of said transportable platen, and said transportable platen together with said platen support have at least one registration set of at least one mating, vertically extending projection and at least one vertically extending recess that are slidable vertically and engageable with each other when said transportable platen resides atop and in contact with said platen support and are slidable vertically so as to be disengagable from each other when said transportable platen is raised above said platen support, whereby when said transportable platen resides atop said platen support, said projection in each registration set extends into said recess in each registration set to immobilize said transportable platen from all movement other than vertical movement relative to said platen support and whereby when said transportable platen is raised above said platen support, said projection and recess in each registration set disengage from each other and said transportable platen is freely movable and totally detached from said platen support.

2. A mechanism according to claim 1 further comprising a plurality of registration sets of mating projections and recesses.

3. A mechanism according to claim 2 wherein said projections are formed as a plurality of positioning pins depending from said platen and said recesses are formed as a corresponding plurality of positioning apertures defined in said platen support.

4. A mechanism according to claim 3 further comprising a master garment loading and unloading station for use on an upwardly facing, stationary working surface, said master station including an assembly platform having a flat upper surface and a lower surface and a master support secured to said lower surface of said assembly platform to hold it at a spaced elevation above said working surface, and said assembly platform is equipped with positioning apertures to receive said positioning pins of said platen, whereby in a garment loading and unloading position said platen rests atop said assembly platform and is immobilized from horizontal movement relative thereto by engagement of said positioning pins in said positioning apertures in said assembly platform and, whereby otherwise said platen is freely and independently movable relative to said master station when said positioning pins and said positioning apertures are disengaged from each other.

5. A mechanism according to claim 3 wherein said positioning pins and said positioning apertures all are circular in cross-section.

6. The mechanism of claim 1 wherein said platen support is detachable from said garment receiving arm of said garment printing machine and has an undersurface with depending positioning devices that fit into corresponding positioning receptacles on said garment receiving arm of said garment printing machine so as to prevent horizontal movement of said garment support relative to said garment receiving arm when said platen support rests atop said garment receiving arm.

7. The mechanism of claim 6 wherein at least portions of said depending positioning devices and said corresponding positioning receptacles are configured to restrain horizontal movement but to permit free vertical movement of said garment support relative to said garment receiving arm.

8. A mechanism for a garment printing machine having at least one horizontally extending garment receiving arm comprising: a platen support on said garment receiving arm and a transportable platen freely removable from said platen support, wherein said transportable platen is comprised of a horizontally extending garment mount having a flat, horizontal upwardly facing support surface, said mount further including an apparatus for immobilizing at least a print receiving portion of a garment positioned thereon relative to said transportable platen and for urging said print receiving portion of said garment into contact with said upwardly facing support surface of said transportable platen, and said transportable platen together with said platen support have at least one registration set of at least one mating, vertically extending projection and at least one vertically extending recess that are slidable vertically and engageable with each other when said transportable platen resides atop and in contact with said platen support and are slidable vertically so as to be disengagable from each other when said transportable platen is raised above said platen support, whereby when said transportable platen resides atop said platen support, said projection in each registration set extends into said recess in each registration set to immobilize said transportable platen from all movement other than vertical movement relative to said platen support and whereby when said transportable platen is raised above said platen support, said projection and recess in each registration set disengage from each other and said transportable platen is freely movable and totally detached from said platen support, wherein said garment is further comprised of a forward portion and a rearward portion with said print receiving portion located therebetween, and said garment is further comprised of a capturable portion, and said garment mount is further comprised of:

a rigid baseplate having an undersurface and an upper surface for supporting thereabove at least said print receiving portion of said garment, a pedestal secured atop said rigid baseplate, a flat, rigid print panel support plate having a bottom surface and said panel support plate is secured at said bottom surface thereof atop said pedestal and overhangs said pedestal so as to create opposing first and second gaps between said bottom surface of said print panel support plate and said upper surface of said baseplate, whereby said first gap receives said capturable portion of said garment therewithin, a garment depressing mechanism engageable with said forward portion of said garment to urge said forward portion of said garment into contact with said flat upper surface of said baseplate, and a stretching device removably engageable with said rearward portion of said garment to urge said rearward portion of said garment toward said second one of said opposing gaps to thereby stretch said print receiving portion of said garment in a fore and aft direction thereby urging said print receiving portion into contact with said flat, horizontally upwardly facing support surface of said print panel support plate.

9. A mechanism according to claim 8 wherein said baseplate is formed with a pair of laterally separated first and second side edges extending in a fore and aft direction, and said garment depressing mechanism is formed with a holddown bar having proximal and distal ends, an articulated double hinge joint located on said first of said side edges of said baseplate and secured to said proximal end of said holddown bar so as to permit rotation of said holddown bar about both horizontal and vertical axes of rotation, and a holddown bar catch located on said second of said side edges of said baseplate, whereby said holddown bar is rotatable to a deployed position to extend across said baseplate in spaced separation therefrom above said upper surface thereof and engageable in said holddown bar catch to press said forward portion of said garment against said upper surface of said baseplate and a storage position extending alongside said first one of said side edges of said baseplate.

10. A mechanism according to claim 9 wherein both said double hinge apparatus and said holddown bar catch are movable to positions no higher than said upper surface of said baseplate.

11. A platen for use in printing on a flexible garment that has a forward portion, a rearward portion, a print receiving portion located therebetween, and a capturable portion located between said print receiving portion and said forward portion, said platen comprising:

a rigid base plate having an undersurface and an upper surface for supporting thereabove at least said print receiving portion of said garment, a pedestal secured atop said rigid base plate, a flat, rigid print panel support plate having a bottom surface and a flat top surface and secured at said bottom surface thereof atop said pedestal and overhanging said pedestal so as to create opposing first and second gaps between said bottom surface of said print panel support plate and said upper surface of said baseplate, whereby said first gap receives said capturable portion of said garment therewithin, a plurality of registration projections depending vertically from said undersurface of said baseplate, a garment depressing mechanism mounted on said baseplate and engageable with said forward portion of said garment to urge said forward portion of said garment into contact with said flat upper surface of said baseplate, a stretching insert removably engageable with said rearward portion of said garment and insertable into said second one of said opposing gaps to jam said rearward portion of said garment into said second one of said opposing gaps to thereby stretch said print receiving portion of said garment in a fore and aft direction, thereby urging it into contact with said flat top surface of said print panel support plate.

12. A platen according to claim 11 wherein said baseplate is formed with a pair of laterally separated first and second side edges extending in a fore and aft direction, and said garment depressing mechanism is formed with a holddown bar having proximal and distal ends, an articulated double hinge joint located at said first of said side edges of said baseplate and secured to said proximal end of said holddown bar so as to permit rotation of said holddown bar about both horizontal and vertical axes of rotation, and a holddown bar catch located at said second of said side edges, whereby said holddown bar is rotatable to a deployed position to extend across said baseplate in spaced separation therefrom and above the upper surface thereof and engageable in said holddown bar catch to press said forward portion of said garment against said upper surface of said baseplate, and a storage position extending alongside said first one of said side edges.

13. A platen according to claim 12 wherein both said double hinge apparatus and said holddown bar catch are movable to positions projecting no higher than said upper surface of said baseplate.

14. A platen according to claim 11 wherein said flexible garment is a hat having a crown and a front bill and said panel support plate is and about 4 inches in length in a fore and aft direction and no greater than about 7 inches in lateral width.

15. A platen according to claim 11 wherein said first and second gaps each have a width no greater than about one 3/16 of an inch.

16. The combination of a platen and a platen support for a garment printing machine that has at least one horizontally extending garment receiving arm upon which said platen support is secured and said platen is freely removable from said platen support, wherein said platen is comprised of a horizontally extending garment mount having a flat, horizontal upwardly facing garment support surface with a peripheral margin thereabout, said mount further including an apparatus for immobilizing at least a print receiving portion of a garment positioned thereon relative to said platen and for urging said print receiving portion of said garment into contact with said horizontal, upwardly facing garment support surface of said platen, and said platen together with said platen support have at least one mating, vertically extending projection and at least one vertically extending recess that are slidably engageable with each other in a vertical direction when said platen resides atop and in contact with said platen support and slidingly disengageable from each other in a vertical direction when said platen is raised above said platen support in vertical separation therefrom, whereby when said platen resides atop said platen support, said projection extends into said recess to immobilize said platen from all movement other than vertical movement relative to said platen support and whereby when said platen is raised above said platen support said projection and recess disengage from each other and said platen is freely and totally detached from said platen support.

17. The combination of according to claim 16 wherein said platen support is detachable from said garment receiving arm of said garment printing machine and has an undersurface with depending positioning devices that fit into corresponding receptacles on said garment receiving arm of said garment printing machine so as to prevent movement of said garment support other than vertically relative to said garment receiving arm.

18. The combination of claim 17 wherein at least portions of said depending positioning devices are of uniform cross-section along their length so as to permit controlled vertical movement of said garment support relative to said garment receiving arm.

19. The combination of claim 16 wherein said garment mount is comprised of a flat baseplate having upper and lower surfaces and a print panel support plate having a flat upper surface forming said upwardly facing garment support surface and a spacing mechanism interposed between said baseplate and said print panel support plate so is to create at least one gap between said print panel support and said upper surface of said baseplate and further comprising a pair of mutually parallel, longitudinally extending guide strips secured to said lower surface of said baseplate, and said platen support has mutually parallel side edges so that said platen support has a uniform width along its length, whereby when said platen is lowered onto said platen support said guide strips reside alongside said side edges of said platen support so as to prevent relative movement in a lateral direction between said baseplate of said platen and said platen support.

20. The combination of claim 19 wherein said at least one mating vertically extending projection depends from said garment mount and further comprising a master garment loading and unloading station including an assembly platform having at least one vertically extending recess defined therein configured to receive said at least one vertically extending projection in mating engagement therewith, and said assembly platform has side edges spaced apart a uniform distance equal to said width of said platen support so as to prevent lateral movement of said baseplate relative to said assembly platform, and said assembly platform has at least one positioning recess defined therein and a laterally extending window defined therethrough, and further comprising a cylindrical roller mounted on said master station for rotation about a laterally extending axis of rotation and so as to protrude through said laterally extending window of said platen assembly platform, and said platen baseplate also has a laterally extending window defined therethrough so that said roller also protrudes through said window of said baseplate as well as said window of said assembly platform when said platen is positioned atop said assembly platform and said vertically extending projection resides in mating engagement with said vertically extending recess in said assembly platform.

21. The combination of according to claim 20 wherein said spacing mechanism is comprised of a laterally extending spacing strip located longitudinally remote from said window in said baseplate and said apparatus for immobilizing at least said print receiving portion of said garment is comprised of a frame removably positioned atop said print panel support plate and residing above and pressing downwardly toward said peripheral margin of said upwardly facing garment support surface.

* * * * *